US005584352A

United States Patent [19]

Beavers

[11] Patent Number: 5,584,352

[45] **Date of Patent: * Dec. 17, 1996**

[54] PNEUMATIC DRILLING CHIP REMOVAL SYSTEM AND METHOD

[75] Inventor: Roger L. Beavers, Geary, Okla.

[73] Assignee: B.J.S. Systems, Inc., Geary, Okla.

[ * ] Notice: The term of this patent shall not extend beyond the expiration date of Pat. No. 5,407,020.

[21] Appl. No.: 361,394

[22] Filed: Dec. 22, 1994

Related U.S. Application Data

[63] Continuation of Ser. No. 53,939, Apr. 26, 1993, Pat. No. 5,407,020.

[51] Int. Cl.[6] ..... E21B 7/18; E21B 21/10

[52] U.S. Cl. ..... 175/71; 175/317; 175/324

[58] Field of Search ..... 175/71, 324, 317, 175/218

[56] References Cited

U.S. PATENT DOCUMENTS

| | | | |
|---|---|---|---|
| 1,715,547 | 6/1929 | Hardesty | 175/325.3 |
| 2,805,043 | 9/1957 | Williams, Jr. | 175/324 X |
| 3,334,697 | 8/1967 | Edwards et al. | 175/71 |
| 4,489,793 | 12/1984 | Boren | 175/71 |
| 4,540,055 | 9/1985 | Drummond et al. | 175/324 X |
| 4,583,603 | 4/1986 | Dorleans et al. | 175/324 |
| 4,615,399 | 10/1986 | Schoeffler | 175/317 X |
| 4,645,006 | 2/1987 | Tinsley | 175/324 X |
| 4,817,739 | 4/1989 | Jeter | 175/324 X |
| 4,852,667 | 8/1989 | Dorleans | 175/324 X |
| 4,958,692 | 9/1990 | Anderson | 175/325.3 |
| 5,407,020 | 4/1995 | Beavers | 175/71 |

FOREIGN PATENT DOCUMENTS

| | | | |
|---|---|---|---|
| 8404942 | 12/1984 | WIPO | 175/324 |

*Primary Examiner*—Hoang C. Dang
*Attorney, Agent, or Firm*—Dunlap & Codding, P.C.

[57] ABSTRACT

A pneumatic drilling chip removal system for removing drilling chips from a well bore, comprising sub-surface drilling equipment having a plurality of components and a drilling bit, a central passageway extending through the components and to the air jets in the drilling bit, wherein at least one component above the drilling bit in the sub-surface drilling equipment is a pneumatic component having an opening forming a pneumatic conduit from the central passageway to the annulus, a bypass valve disposed therein selectively permitting air flow from the central passageway to the annulus, forming a supplementary air source for removal of drilling chips from the well bore. Methods for using a pneumatic drilling chip removal system.

18 Claims, 19 Drawing Sheets

40
48
74
78
82
54
72
76
80
66
25
54'
62
64
58
56
52
60
68
24
36
54''
84
70
16
90
88
92
93
38
86
22

PNEUMATIC DRILLING CHIP REMOVAL SYSTEM AND METHOD

This is a continuation, now the U.S. Pat. No. 5,407,020 Ser. No. 08/053,939 filed on Apr. 26, 1993.

BACKGROUND OF THE INVENTION

1. Field of the Invention

The present invention relates generally to drilling equipment, and in particular, to sub-surface drilling equipment which utilizes a pneumatic drilling chip removal system.

2. Background Information

In the drilling or making of a hole into any substrate for the primary purpose of producing a gas or liquid, as the hole for the well is bored out, it is an operational requirement to remove the drilling debris cut and chipped away, hereinafter referred to as drilling chips, from the bottom of a well bore.

Frequently in well drilling operations, these drilling chips are removed from the well bore with the use of drilling mud. Drilling mud is a liquid/chemical composition that is injected down the central passageway of the sub-surface drilling equipment and is ejected out through apertures in the drilling bit at the bottom of the well bore. The drilling mud picks up the drilling chips as the drill bit chips them from the substrate and moves upward in the annulus (the space between the well sidewall and the sub-surface drilling equipment). Both drilling mud and the drilling chips contained therein are discharged at the surface into a means for separating the drilling chips and other solid material from the drilling mud.

Drilling mud has a number of disadvantages. Water base drilling mud is expensive to mix and maintain; oil base and polymer base drilling mud are usually leased, and like water base, both are very expensive to maintain. These drilling muds must be handled carefully due to their toxicity, and must be recycled during drilling operations. That is, recycling equipment must be used to remove drilling chips from the drilling mud, so that the drilling mud may be reused again. The drilling mud, due to its toxicity, also requires special disposal methods. Finally, drilling time is increased when drilling mud must be used. In average rock or rock-like substrate, the drilling time when drilling mud is utilized is about three to fifteen minutes per foot. Drilling mud is required, however, at a certain depth, in most drilling operations. The reasons behind this requirement will be explained below.

In the instance of a relatively hard substrate, it has been recognized that drilling chips are generally light enough to be removed from a well bore through the use of a pneumatic drilling chip removal system, which utilizes high pressure air rather than drilling mud for the removal of drilling chips from a well bore. In effect, as the well bore is deepened, and the sub-surface drilling equipment is progressively lowered into the well bore, a controlled volume of high pressure air is injected into the central passageway of the sub-surface drilling equipment. The air is ejected out through jets in the drilling bit at the bottom of the well bore. As the drilling chips are chipped from the substrate by the drilling bit, the drilling chips are picked up and propelled upward by the air ejected from the drilling bit at the bottom of the well. The air forms an air stream up the annulus of the well which carries the drilling chips up the annulus to the surface where the drilling chips are removed. Pneumatic drilling chip removal is desirable in hard substrate, because the well may be drilled more rapidly with a pneumatic drilling chip disposal system. On the average, a pneumatic drilling chip removal system permits the well bore to be deepened at the rate of about one to three feet per minute. Since no costly drilling materials, such as drilling mud, recycling equipment, or specialized disposal is required, the cost of drilling using a pneumatic drilling chip removal system are much less than conventional drilling operations using drilling mud to remove drilling chips. Further, since toxic material is not involved, the use of pneumatic drilling chip removal is generally safer than the continued use of drilling mud for the entire well.

In the normal operation of sub-surface drilling equipment, a drilling bit is connected to a plurality of drill collars. The drilling bit is of the type normally used in a substrate which is comprised basically of a solid or rock-like formation. The drill collars disposed immediately above the drilling bit are connected end to end, each drill collar having a central passageway. The plurality of drill collars are coupled together in segments. Each segment comprises one or more drill collars of the same external diameter. Each segment has a smaller outer diameter as compared to the next lower segment of drill collars. The respective segments of drill collars are connected together by a change over sub, which connects each segment together. That is, when a larger size drill collar is to be attached to a similar drill collar of a smaller size, a change over sub is normally utilized. The change over subs act as adapters between segments, and also have a central passageway disposed therethrough. The segments of drill collars with their respective change over subs are termed the bottom hole assembly. Immediately above the interconnected segments of drill collars is the drilling string, which comprises a plurality of drill pipe connected end to end. The drilling string also has a central passageway which extends therethrough and connects to the central passageway of the drill collars segments. A change over sub (or, a top collar sub) is utilized to connect the lowest drill pipe in the drilling string to the highest drill collar of the bottom hole assembly.

The central passageway creates a passage for pressurized air which is injected at the surface via a pressurized air source. The pressurized air passes through the entire length of the sub-surface drilling equipment via the central passageway to the drilling bit at the bottom of the well. The air from the central passageway is ejected from the drilling bit via air jets in the drilling bit and travels upward through the annulus for expulsion at the surface. As the pressurized air travels upward from the bottom of the well bore to the surface, the air carries the drilling chips to the surface for removal.

In normal drilling operations, the segment having the largest drill collars are connected immediately above the bit, with size and external diameter of each consecutively higher segment of drill collars decreasing. The drilling string comprises the longest segment of the sub-surface drilling equipment, and also the segment having the narrowest external diameter. The drilling string connects to the surface drilling equipment, and to a source of pressurized air, so that air may be directed down the sub-surface equipment, as previously described. The sub-surface equipment can be formed of sufficient length to extend from the surface to a subterranean liquid or gas bearing reservoir. The pneumatic drilling chip removal system, however, may be utilized, generally, for only about 1,000–3,000 feet when drilling large diameter holes.

Due at least in part to the conical neck of the change over subs, and the narrowing of the sub-surface drilling equipment in the upper portions of the annulus, thereby increasing the annular space significantly in the well bore, the present pneumatic drilling chip removal system has been inadequate for removal of drilling chips at depths generally greater than 3,000 feet in large diameter holes. This is due to significant suspension of drilling chips in the annulus as the depth of the well bore increases, as well as significant drilling chip accumulation in the bottom of the well bore.

The conical neck of the change over subs, the progressive narrowing of the sub-surface equipment as it approaches the surface, and the depth of the well bore create air spaces having an ineffective air lift in which the drilling chips increasingly become suspended or become deposited, creating blockages. These ineffective air spaces are referred to herein as "critical lift areas." In addition, when the pressurized air is turned off, and additional drill pipe is added to the sub-surface equipment, the drilling equipment must be raised by the draw works, and the drilling chips suspended in the annulus or deposited against the conical surfaces of the change over subs fall to the bottom of the well bore. The drilling bit must then re-drill through these drilling chips, and the re-drilling process consumes significant time. That is, on an average, re-drilling through drilling chips in the bottom of the well bore frequently is much more time consuming than drilling the rock or rock-like substrate. Eventually, the blockage of drilling chips, and re-drilling the well bore through the drilling chips, reduces drilling efficiency such that another means of drilling chip removal, namely, drilling mud, must be utilized.

In overcoming this operational problem, which is currently encountered in present pneumatic systems for removing drilling chips from a well bore, disclosed herein is a means whereby portions of the sub-surface drilling equipment is adapted to furnish a supplementary flow of air directly into the annulus at critical lift areas. "Critical lift areas" are defined as areas where there is inadequate air velocity to propel drilling chips upward in the annulus, so that such drilling chips may be removed at the surface. These supplementary pressurized air flows are introduced at points where they will add and maintain the velocity of the air flow in the critical lift areas and throughout the annulus as the external diameter of the upper drill collars decrease, thereby reducing and/or eliminating critical lift areas and the associated suspension and/or accumulation of drilling chips in significant amounts. In the present invention, as the area in the annulus between the sub-surface drilling equipment and the well bore increases, so does the air flow. This additional air flow in the critical lift areas maintains the overall velocity of the air flow within the annulus, and the drilling chips therefore continue to be propelled to the surface, therefore reducing and/or eliminating drilling chip build up and drilling chip blockages in the annulus.

The supplementary air is furnished by tapping the primary air flow from the central passageway. The change over subs and/or the drill pipe, as well as other drilling equipment, are adapted as will be described in detail below, to selectively direct air flow into the critical lift areas via conduits containing specialized valves. The selectively directed air flow is triggered by increased air pressure in the central passageway and the annulus, that is, when significant drilling chip accumulation in the annulus has begun, or, alternatively, when the depth of the well requires increased air velocity to propel the drilling chips through the annulus to the surface.

An advantage of the pneumatic drilling chip removal system described herein is to permit much more extensive use of pneumatic drilling chip removal while drilling bath large diameter well bores as well as small diameter well bores. Further, it will be appreciated that the use of the disclosed pneumatic drilling chip removal system will reduce the cost of drilling wells, will decrease drilling time, and will enhance environmental safety.

BRIEF DESCRIPTION OF THE DRAWINGS

Other objects, features and advantages of the present invention will become more fully apparent from the following detailed descriptions of the preferred embodiments, the appended claims and the accompanying drawings in which:

FIG. 6 shows a schematic transverse view of the bypass valve disposed in the conduit of the present invention;

DESCRIPTION OF THE PREFERRED EMBODIMENTS

In drilling a liquid or gas well using available pneumatic drilling chip removal systems, problems arise. The conical neck of the change over subs, used to link different sections of drill collars together in the bottom of the well bore, cause problems. This conical configuration causes ineffective air lift areas which occur near the conical necks of the change over subs when pressurized air is injected through the sub-surface drilling equipment and into the annulus of the well to remove drilling debris (i.e., drilling chips) bored from the bottom of the well bore. The ineffective air lift areas (hereinafter termed "critical lift areas") permit drilling chips to become suspended or deposited in the annulus of the well bore, causing blockages.

The present invention offers a solution to these problems. A modified change over sub having at least one conduit for air flow and at least one bypass valve disposed therein is disclosed. The modified change over sub permits a selective air flow into the critical lift areas (defined above), thereby providing supplementary air flow into the annulus to facilitate drilling chip removal. Further modifications of standard drilling equipment, including drilling pipe, roller reamers, and blade stabilizers, and new drilling equipment components (adapters) are also disclosed herein. Each of the aforementioned components is modified, or created, to permit selective air flow through conduits and bypass valves disposed in each component as described herein, permitting pneumatic drilling chip removal for a greater variety of drilling operations. The pneumatic drilling chip removal system disclosed herein permits the pneumatic removal of drilling chips at far greater well depths than have ever been achieved in the past.

The Embodiments and Methods of FIGS. 1–13

Figure 1:
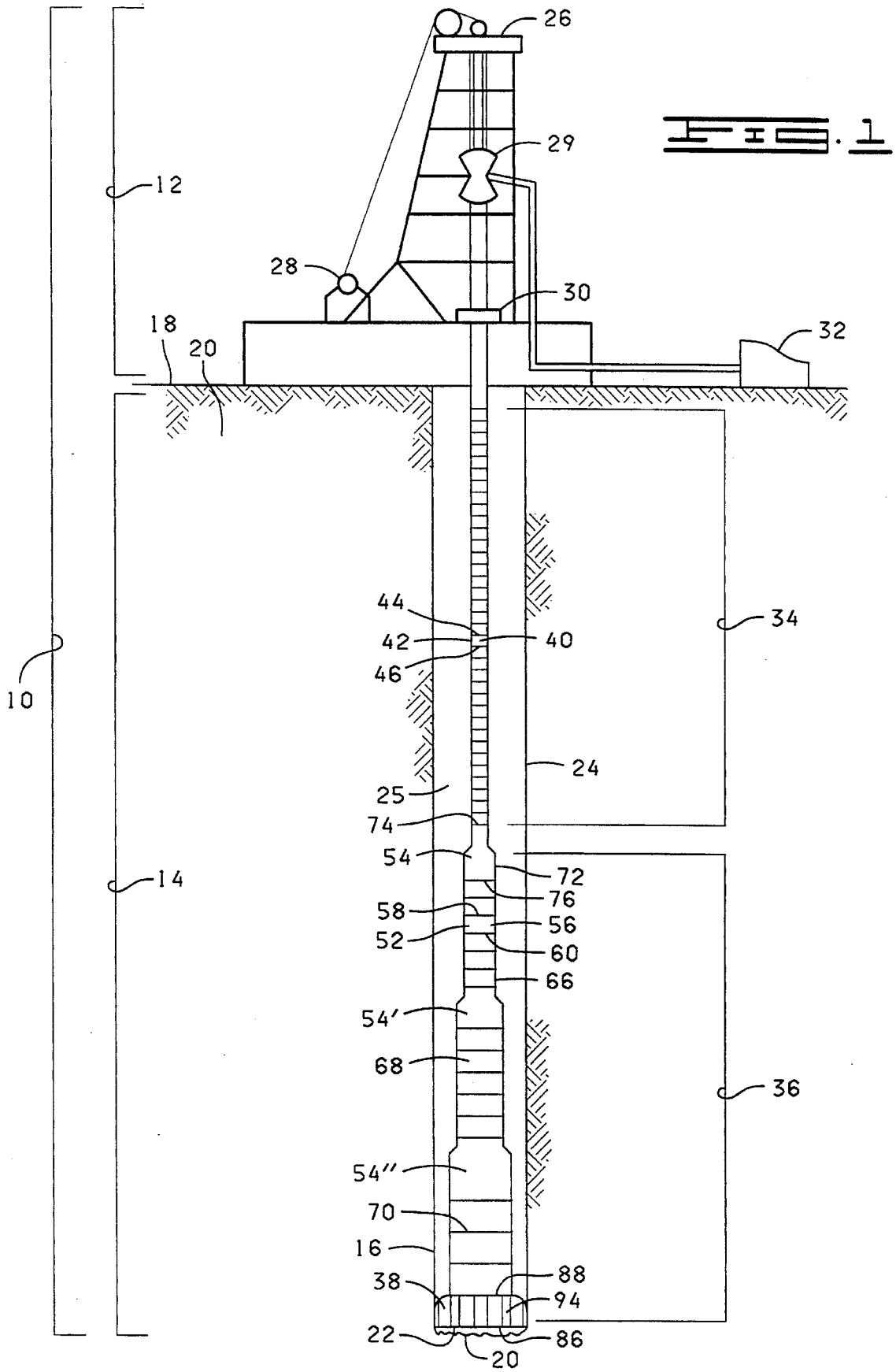
FIG. 1 is a schematic side view of a standard pneumatic drilling chip removal system, showing both the surface drilling equipment and the sub-surface drilling equipment.
Figure 2:
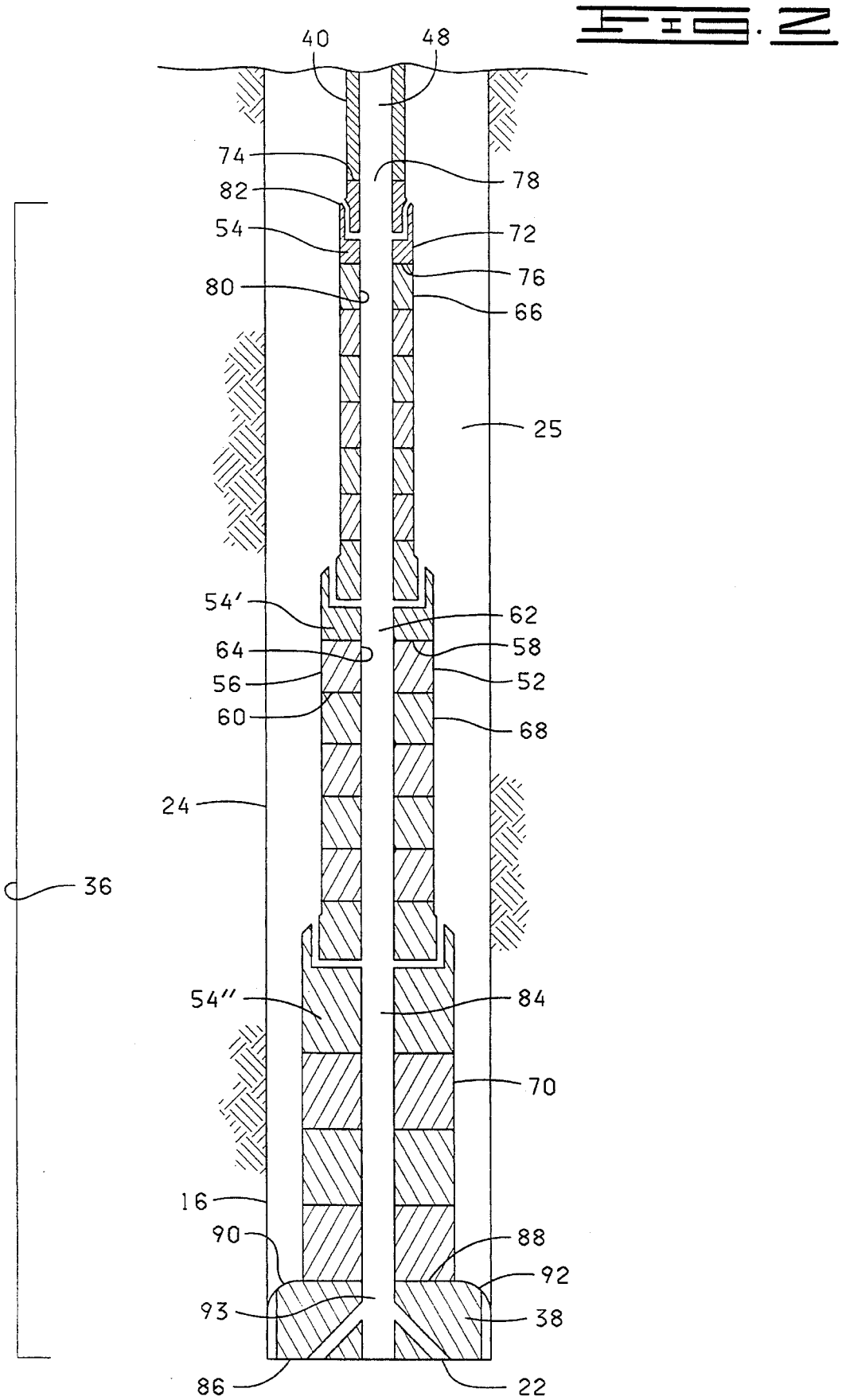
FIG. 2 is a schematic transverse view of the lower drilling string and the bottom hole assembly of the present invention.

Referring to the drawings in detail, and particularly to FIGS. 1 and 2, reference character 10 designates drilling equipment used to drill liquid and/or gas wells. The drilling equipment 10 comprises surface drilling equipment 12 and sub-surface drilling equipment 14. A well bore 16 of generally cylindrical shape (some variations exist on the shape of the well bore, as will be discussed below) is bored into the earth, with an opening remaining at the surface 18, earth substrata 20 at the opposite drilling end 22, and cylindrical side walls 24 along the entire length of the well bore 16. The sub-surface drilling equipment 14 is disposed in the well bore 16. The space between the side walls 24 and the sub-surface drilling equipment 14 is defined as the annulus 25. Located directly above the well bore 16, on the earth surface 18, and connected to the sub-surface drilling equipment 14, is surface drilling equipment 12. Included as part of the surface drilling equipment 12 is the metal superstructure 26, the draw works 28 and blocks 29, the rotary table 30, and the pressurized air source 32.

"Sub-surface drilling equipment" 14 is defined as all drilling equipment which is placed and utilized below the earth surface 18, and which is used to drill the well bore 16 and/or is placed in the well bore 16. Sub-surface drilling equipment comprises a drilling string 34, and a bottom hole assembly 36, which includes a drilling bit 38.

The upper most portion of the sub-surface drilling equipment 14 is the drilling string 34. The drilling string 34 comprises a plurality of sections of drill pipe 40 (only one drill pipe is designated 40). Each drill pipe 40 is cylindrical in shape, having an outer surface 42, a first end 44, a second end 46, both of which are intersected by an opening 48 (not shown) extending therethrough, forming an inner surface 50 (not shown). All drill pipe 40 generally have equivalent external and internal diameters. Each drill pipe 40 is connected end to end in a manner known in the art with the next adjacent drill pipe 40 in the drilling string 34. Drill pipe 40 is comprised of a relatively light, flexible metal or alloy, usually primarily steel.

Connected to the lower end of the drilling string 34 is a bottom hole assembly 36. The bottom hole assembly 36 comprises a plurality of drill collars 52 and a plurality of change over subs 54. Drill collars 52 (only one drill collar designated 52) are generally cylindrical in shape, having an outer surface 56, a first end 58, a second end 60, both of which are intersected by an opening 62 (FIG. 2) extending therethrough, creating an inner surface 64 (FIG. 2). Drill collars 52 have a larger external diameter than drill pipe 40, but drill collars 52 have an inner surface 64 having a diameter which is substantially identical to the internal diameter of drill pipe 40. Drill collars 52 are comprised of a relatively heavy metal or alloy, most frequently steel. It will be noted that the drill collars 52 have various external diameters.

Shown in FIGS. 1 and 2 are three segments of drill collars 52, namely, the first segment 66, comprising the drill collars 52 having the smallest external diameter, the second segment 68, comprising drill collars 52 having an intermediate diameter (in between the smallest size drill collars 52 and the largest size drill collars 52), and a third segment 70, comprising drill collars 52 having the largest external diameter. The first segment 66, the second segment 68, and the third segment 70 have a predetermined number of drill collars 52. The number of drill collars 52 in each segment is determined by well depth, the nature of the substrata 20, the planned drilling strategy, and the like. The drill pipe 40 is connected to the drill collars 52 via a change over sub 54 (only one change over sub is designated 54). Change over subs 54 function to facilitate a connection between the drill pipe 40 and the first segment 66 of drill collars 52, or alternatively, between drill collars 52 of varying diameters.

Figure 3:
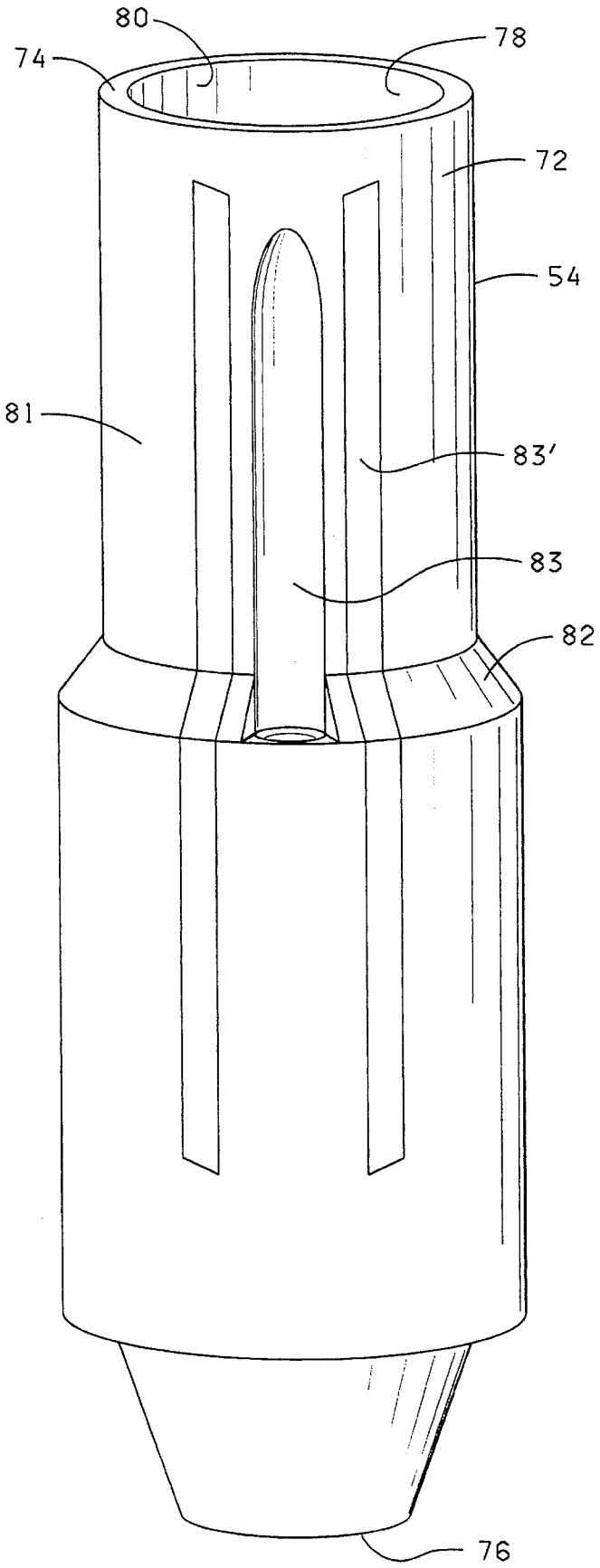
FIG. 3 is a schematic perspective view of the outer surface of a modified change over sub of the present invention.

Referring to FIGS. 1–3, the modified change over sub 54 comprises an outer surface 72 having a modified cylindrical shape, an upper end 74, a frusto-conically shaped lower end 76, both of which are intersected by an opening 78 extending therethrough, forming an inner surface 80. The inner surface 80 has substantially the same internal diameter as that of the drill pipe 40 or drill collars 52. The upper end 74 corresponds to the external diameter of the drill pipe 40 or drill collar 52 immediately above the change over sub 54, to facilitate its connection thereto. Immediately below the cylindrical upper end 74 is a conical neck 81 having a portion 82 which elongates and extends cylindrically downward toward the lower conical end 76, and which is of a greater external diameter than the cylindrical upper end 74, thereby permitting the lower end 76 of the change over sub 54 to connect to a drill collar 52 having the same external diameter immediately below it. Both the upper end 74 and the lower end 76 are connected to drill pipe 40 or drill collars 52 in a manner which is known in the art. A longitudinal groove 83 extends over the outer surface 72. To each side of the longitudinal groove 83 are a plurality of strips of hard band material 83'(only one strip designated 83'). An opening which will be described in detail below, is formed in the change over sub 54. It will be noted that with progression of the sub-surface drilling equipment 14 downward into the well bore 16, each change in size of drill collars 52 requires a change over sub 54 to interconnect the respective drill collars 52 of different sizes.

As illustrated in FIGS. 1 and 2, a first change over sub 54 is utilized to connect the drill pipe 40 to the first segment 66 of drill collars 52. A second change over sub 54'is utilized to connect the first segment 66 of drill collars 52 to the second segment 68 of drill collars 52. A third change over sub 54"is utilized to connect the second segment 68 of drill collars 52 to the third segment 70 of drill collars 52.

It will be appreciated that the internal diameter of all sub-surface drilling equipment 14 is approximately the same (FIG. 2). That is, the opening 48 in the drill pipe 40, the opening 62 in the drill collars 52, and the opening 78 in the change over subs 54 collectively form a hollow central passageway 84 which extends from the surface 18 and the surface drilling equipment 12 to near the drilling end 22 of the well bore 16. The central passageway 84 permits the injection of pressurized air from the pressurized air source 32 on the surface 18, down through the sub-surface drilling equipment 14 to the drilling bit 38.

As illustrated in FIG. 2, the lowest component of the bottom hole assembly 36, attached to the lowest drill collar 52, is the drilling bit 38. The drilling bit 38 comprises a lower drilling surface 86, which lies adjacent to the substrata 20 and which rotatably engages and removes portions of the substrata 20 in the form of drilling debris when rotated thereagainst. The drilling bit 38 also has a flat upper portion 88 which connects to the lowest drill collar 90 and the central passageway 84, and a curved upper portion 92 which extends beyond the widest diameter of the bottom hole assembly 36. A plurality of openings comprising air jets 93 (only one air jet being designated by 93) are disposed in the drilling bit 38. The plurality of air jets 93 extend between the flat upper portion 88 of the drilling bit 38 which interfaces with the central passageway 84 and the lower drilling surface 86 of the drilling bit 38. The lower drilling surface 86 of the drilling bit 38 has semi-circular apertures 94 (FIGS. 2, 12, 13) which permit the expulsion of drilling debris via the air flow from the air jets 93, the drilling debris being propelled from under the lower drilling surface 86 of the drilling bit 38 via the plurality of air jets 93 through the semicircular apertures 94 and into the annulus 25. The plurality of air jets 93 connect to and are in pneumatic communication with air flow from the central passageway 84, thereby permitting the pressurized air injected down the central passageway 84 to be ejected into the annulus, via the air jets 93, as shown in FIG. 2.

Figure 13:
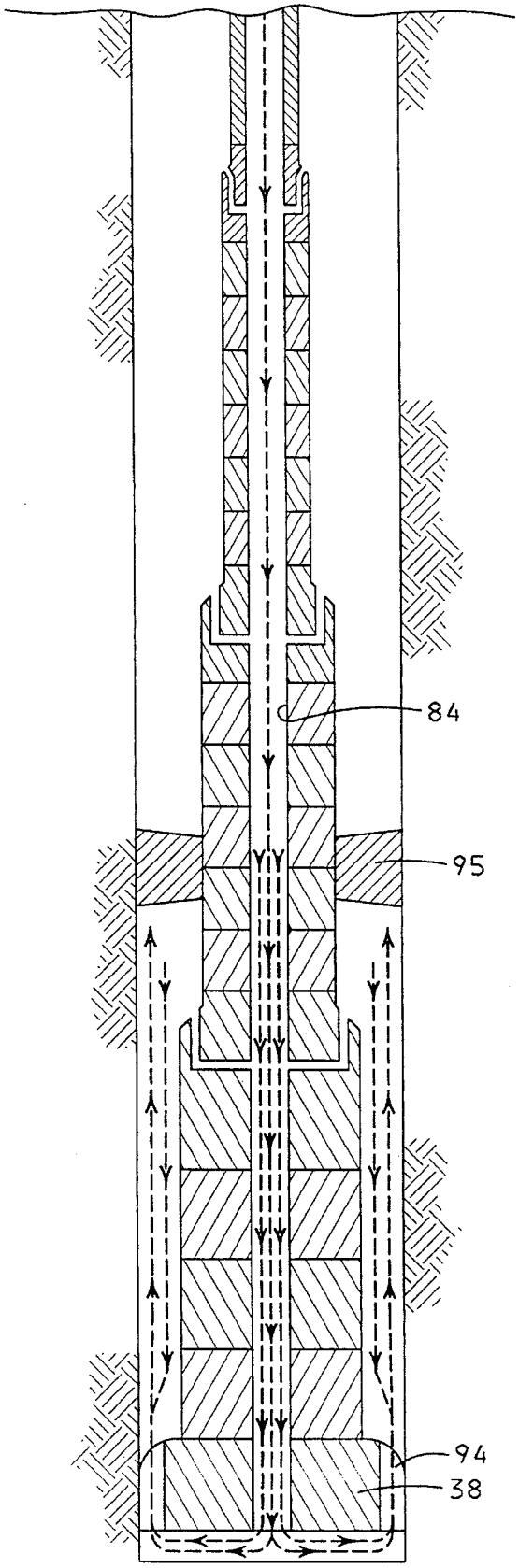
FIG. 13 shows a schematic transverse view of the lower drilling string and bottom hole assembly of the present invention, showing the change over subs having conduits and bypass valves therein, the bypass valves in a closed position, a blockage in the annulus, and the air flow directed through the air jets in the drilling bit to increase air pressure in order to break up said blockage.

Referring briefly back to FIG. 1, it will be understood by those skilled in the art that the rotary table 30 rotates the drilling string 34, the bottom hole assembly 36, and the drilling bit 38 attached thereto, thereby engaging the substrata 20 at the drilling end 22 of the well bore 16. The engagement permits portions of the substrata 20 to be drilled away, thereby deepening the well bore 16. The debris from drilling the well bore 16 is called drilling chips 95 (FIG. 13). Drilling chips 95, as defined herein, encompasses all debris drilled from the well bore 16. It will be further understood by those having skill in the art that the sub-surface drilling equipment 14 is raised and lowered by the draw works 28. The draw works 28 and blocks 29 permit additional drill collars 52 and change over subs 54 to be added to the bottom hole assembly 36, and additional drill pipe 40 to be added to the drilling string 34, as the well bore 16 is deepened.

Figure 4:
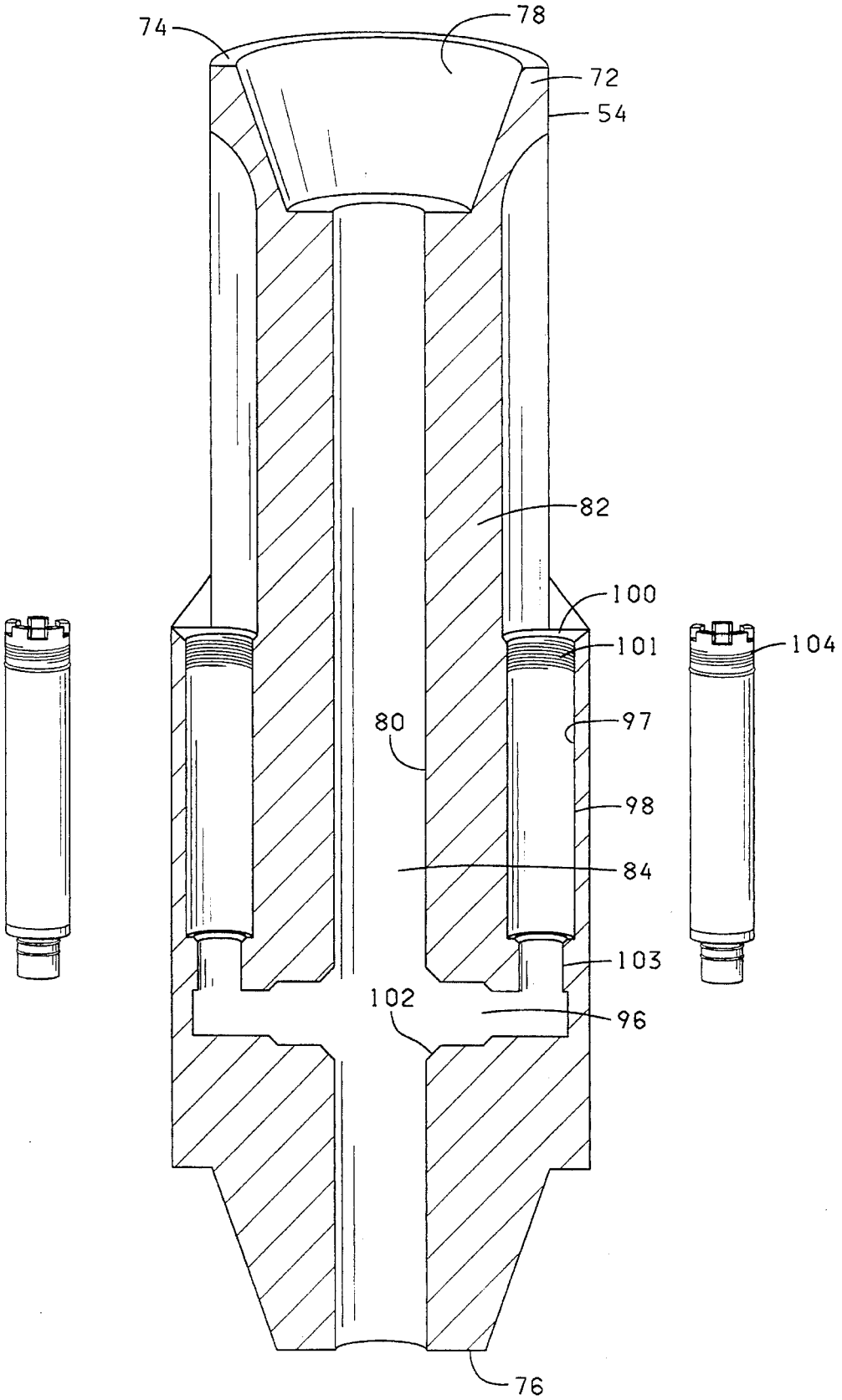
FIG. 4 is a schematic transverse view of a modified change over sub, showing the location and general configuration of the conduits and the bypass valves of the present invention.

Referring now to FIG. 4, the change over sub 54 has at least one or more openings 96 (while two are shown herein, only one opening is designated 96) which intersects the inner surface 80 of the change over sub 54 and the central passageway 84. (The term "change over sub" comprises both the typical change over sub shown and described herein, as well as a top collar (not shown), which is of a frusto-conical configuration and well known in the art, but which is utilized in the art to connect the lowest drill pipe 40 to the highest drill collar 52.) The opening 96 extends outward at a perpendicular angle from the inner surface 80 and the central passageway 84, and then bends in a ninety degree angle upward, the opening 96 extending through the conical neck 81 of the change over sub 54, forming an auxiliary inner surface 97 and an "L" shaped conduit 98, as shown in FIG. 4 (only one conduit designated 98). The conduit 98 has an upper end 100 which has spiralling grooves 101 therein, a lower end 102 and a narrow neck 103. The conduit 98 permits pneumatic communication between the central passageway 84 and the annulus 25 (FIG. 1). To this end, the upper end 100 of the conduit 98, and the conduit 98 as a whole, is sized to receive a bypass valve 104 (only one bypass valve designated 104).

Figure 5A:
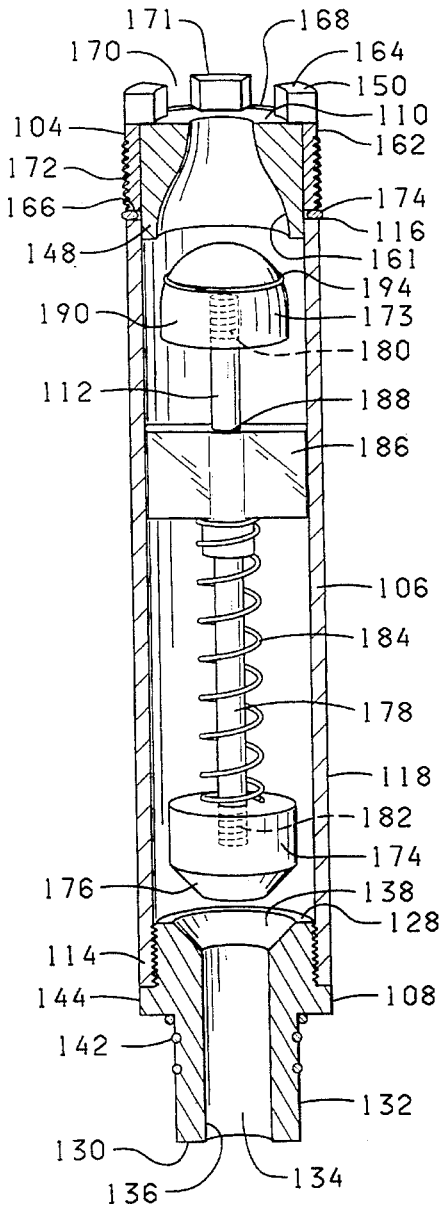
FIG. 5A is a schematic transverse view showing the components of the bypass valve of the present invention.
Figure 5B:
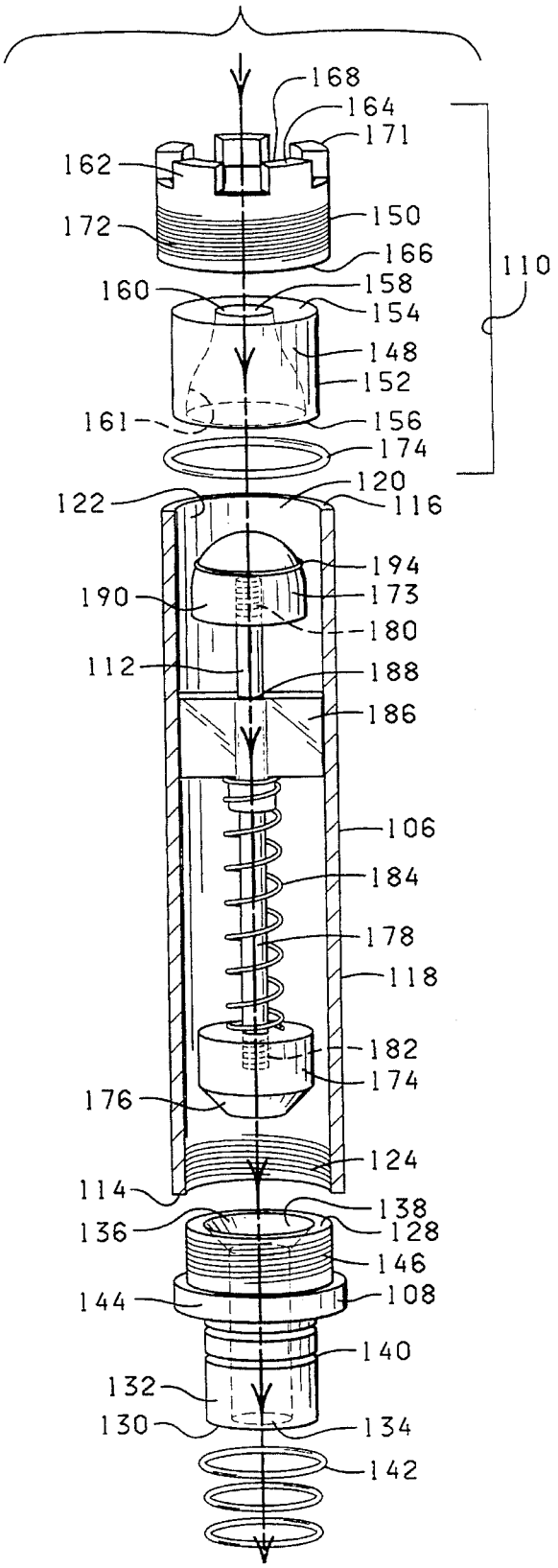
FIG. 5B is a schematic exploded transverse view of the components of the bypass valve of the present invention.
Figure 5:
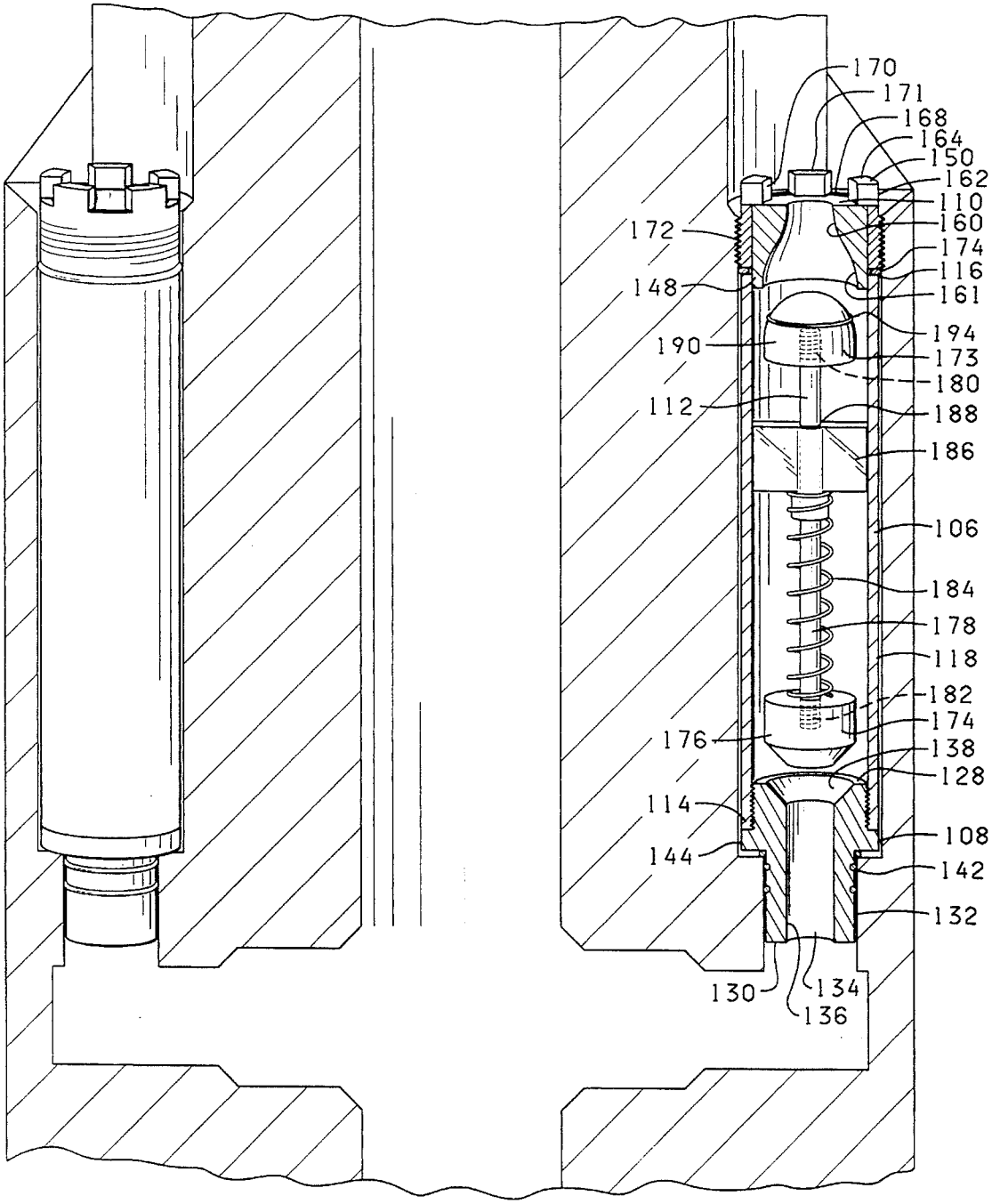

Referring to FIGS. 4, 5 and 6, each change over sub 54 is provided with at least one bypass valve 104. The number of bypass valves 104 utilized in each change over sub 54 is equal to the number of conduits 98 in the change over sub 54. The bypass valve 104 is connected to the change over sub 54, and disposed within the conduit 98, as will be explained further below. The bypass valve 104 is utilized to regulate air flow through both the central passageway 84 and the annulus 25. The bypass valve 104 is selectively opened or closed via defined ranges of air pressure, which are affected by conditions during drilling operations (shown in FIG. 8).

Each bypass valve 104 comprises a hollow sleeve 106, an entrance section 108, an exit section 110, and a dual valve 112. The sleeve 106 comprises a hollow, elongated cylinder. The sleeve 106 has a lower end 114, and an upper end 116, an outer surface 118, and is intersected by an opening 120 which extends through both the lower end 114 and the upper end 116 of the sleeve 106, thereby forming an inner surface 122 throughout the length of the sleeve 106. On the inner surface 122 near the lower end 114 of the sleeve 106 are spiraling grooves 124.

Connected to the lower end 114 of the sleeve 106 is an entrance section 108. The entrance section 108 has a first end 128, a second end 130, an outer surface 132, and an opening 134 therethrough, which forms an inner surface 136. The inner surface 136 near the first end 128 is cylindrically shaped. The inner surface 136 expands outward in a frusto-conical shape to form a lower valve seat 138. The outer surface 132 contains a plurality of circular grooves 140 (only one groove designated 140) which extend around the outer diameter of the second end 130 of the entrance section 108. Disposed on the plurality of grooves 140 are seals 142 (only one seal designated 142)(FIG. 5). The seals 142 may be gaskets, O-rings, or the like. It will be appreciated that each groove 140 will have a seal 142 disposed therein. An equal plurality of the outer surface 132 of the entrance section 108 has a flange 144, which corresponds in external diameter to the external diameter of the lower end 114 of the sleeve 106. Spiralling threads 146 are located on the outer surface 132 of the entrance section 108, near the first end 128, which permit a threaded engagement of the entrance section 108 to the lower end 114 of the sleeve 106.

Connected to the upper end 116 of the sleeve 106 is the exit section 110. The exit section 110 comprises a jet nozzle 148, and a locknut 150.

The jet nozzle 148 has an outer surface 152 which is cylindrical in shape, and a first end 154 and a second end 156. The first end 154 and the second end 156 are intersected by an opening 158, which forms an inner surface 160. The inner surface 160 has a greater diameter near the second end 156, forming a generally rounded frusto-conical shape, forming the upper valve seat 161. The diameter narrows near the first end 154. The second end 156 of the jet nozzle 148 is connected to the upper end 116 of the sleeve 106 by any manner known in the art.

A locknut 150, having a generally cylindrical shape, is used to connect to the jet nozzle 148 and hold the jet nozzle 148 in place at the upper end 116 of the sleeve 106, and to hold the bypass valve 104 in connecting engagement in the conduit 98. The locknut 150 has an outer surface 162, a first end 164, and a second end 166. The first end 164 and the second end 166 are intersected by an opening 168, which forms an inner surface 170. The inner surface 170 of the locknut 150 generally corresponds to and it is slightly greater in diameter than the outer surface 152 of the jet nozzle 148, thereby permitting the lock nut 150 to be slidably disposed over the jet nozzle 148. The locknut 150 further has a plurality of extensions 171 (only one extension designated 171) which extend over the first end 154 of the jet nozzle 148, thereby holding the jet nozzle in place. The outer diameter of the locknut 150 also corresponds generally to the outer diameter of the sleeve 106. The locknut 150 (Fogires 4, 5 and 6) has spiraling threads 172 which extend about the outer surface 162, which correspond to grooves 101 in the upper end 100 of the conduit 98 in the change over sub 54. At least one seal 142, as defined previously, is used to provide a seal between the inner surface 97 of the conduit 98 and the locknut 150, thereby, in combination with the plurality of seals 142 in the entrance section 108, creating a pneumatic seal between the inner surface 97 of the conduit 98 and the bypass valve 104.

The bypass valve 104 further comprises dual valves 112 having multiple parts, including an upper valve 173 and a lower valve 174. The lower valve 174, having an external periphery 176 sized to form a seal against the lower valve seat 138 is disposed in the sleeve 106. An elongated valve stem 178 having a threaded upper end 180 and a threaded lower end 182 is also disposed in the sleeve 106, the threaded lower end 182 of the valve stem 178 being connected to the lower valve 174. A biasing means, preferably a coil spring 184, is disposed about the valve stem 178 between the lower valve 174 and the guide block 186. The coil spring 184 is responsive to pneumatic pressure and adjusts the upper valve 173 and the lower valve 174 against the upper valve seat 161 and the lower valve seat 138, respectively, in response to the air pressure from the central passageway 84, as will be described in detail below. The valve stem 178 slideably extends through the guide block 186, the guide block 186 having a center aperture 188 sized to slideably receive the valve stem 178, the upper end 180 of the valve stem 178 connecting to the upper valve 173. The guide block 186 is rigidly connected to the inner surface of the sleeve 106 by any means known in the art. The guide block 186 may also be mounted in grooves formed in the inner surface 122 of the sleeve 106 (not shown).

The upper valve 173 has an outer periphery 190 sufficiently sized to seal the upper valve 173 against the upper valve seat 161. To this purpose, the upper valve 173 has a circular groove 192 (not shown) which extends about the outer periphery 190 of the upper valve 173, into which is disposed a seal 194. The seal 194 acts to assure an adequate closure of the bypass valve 104 when the upper valve 173 is disposed adjacent to and in contacting engagement with the upper valve seat 161.

The coil spring 184 on the valve stem 178 between the lower valve 174 and the guide block 186 normally urges the lower valve 174 into the closed position against air pressure in the conduit 98 from the central passageway 84. The upper valve 173 is normally spaced away from the upper valve seat 161, in an open position. The force of the coil spring 184 against the guide block 186 will normally maintain the upper valve 173 in an open position.

When sufficient air pressure (as defined below) (FIGS. 9, 10 and 11) in the central passageway 84 occurs, however, the air pressure displaces the lower valve 174 from its seated position against the lower valve seat 138, thereby opening the bypass valve 104 and permitting air to pass from the central passageway 84 through the bypass valve 104 and into the annulus 25 (FIG. 6). When air pressure is very great, however, the lower valve 174 will became displaced against the coil spring 184 to a degree which will urge the upper valve 173 to sealingly engage the upper valve seat 161, to close the bypass valve 104 and therefore prevent air flow from the central passageway 84 to the annulus 25 via the bypass valve 104.

The bypass valve 104 comprises brass or a similar alloy or material which reduces the potential for sparking. It will be appreciated that sparking could have detrimental effects, particularly in the instance of a well containing flammable and/or explosive gases.

The bypass valve 104, minus the exit section 110, is placed into the upper end 100 of the conduit 98 in a change over sub 54, the inner surface 97 of the upper end 100 of the conduit 98 sized to receive the bypass valve 104, the entrance section 108 disposed in the neck 103 of the conduit 98. Seals 142 at the entrance section 108 seal the bypass valve 104 to the inner surface 97 of the conduit 98. The exit section 110 of the bypass valve 104 is connected to the upper end 116 of the sleeve 106, and the locknut 150 is rotatably connected to the upper end 100 of the conduit via the threads 172 on the locknut 150 and the grooves 101 on the inner surface 97 of the upper end 100 of the conduit 98. A seal 194 seals the exit section 110 of the bypass valve 104 to the inner surface 97 of the conduit 98, creating a pneumatic seal between the bypass valve 104 and the inner surface 97 of the conduit 98 (FIG. 6).

Figure 7:
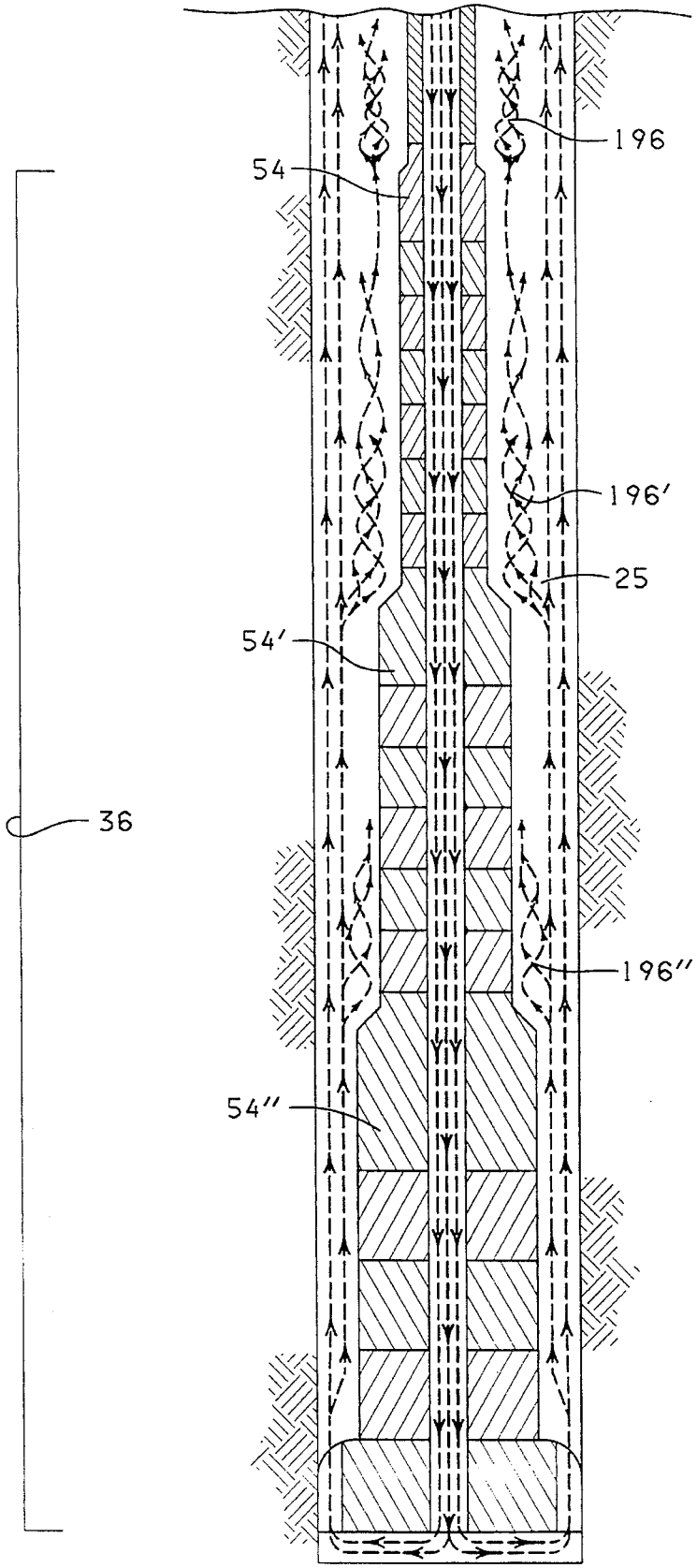
FIG. 7 shows a schematic transverse view of a standard pneumatic drilling chip removal system, showing both lower drilling string and the bottom hole assembly and showing critical lift areas.

In a standard method of pneumatic drilling chip removal during normal drilling operations, the sub-surface drilling equipment 14 is connected to the source of pressurized air 32 on the surface 18. The pressurized air is directed down the central passageway 84 of the sub-surface drilling equipment 14 and emerges into the annulus 25 via the plurality of air jets 93 in the drilling bit 38. The pressurized air, as it is expelled, picks up the drilling chips 95 and moves upward at a velocity sufficient to carry the drilling chips 95 through the annulus 25 to the surface 18 for removal from the well bore 16, thereby permitting the well bore 16 to be deepened via continued drilling operations.

when using the standard pneumatic drilling chip removal systems, due to the shape of the change over subs 54, as well as the well bore 16 being deepened, a plurality of critical lift areas 196 are formed, wherein the air velocity is greatly decreased, as illustrated in FIG. 7, wherein the air velocity is greatly reduced, causing drilling chip 95 suspension and/or blockage. "Critical lift areas" 196 as used herein means areas within the annulus 25 in which there is an ineffective amount of air velocity to lift the drilling chips 95 upward, in which the drilling chips 95 become suspended and/or form blockages. Three critical lift areas 196 are illustrated in FIG. 7, namely, a first critical lift area 196, a second critical lift area 196', and a third critical lift area 196". It will be understood that critical lift areas 196 are more likely to occur near the change over subs 54 in the bottom hole assembly 36.

Figure 8A:
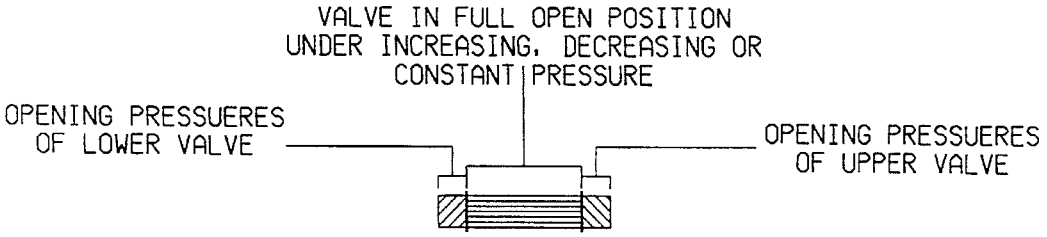
FIG. 8 shows a table of ranges (in PSI) showing the potential pre-selected air pressure ranges which would permit both the opening and the closing of the bypass valve of the present invention.
Figure 8B:
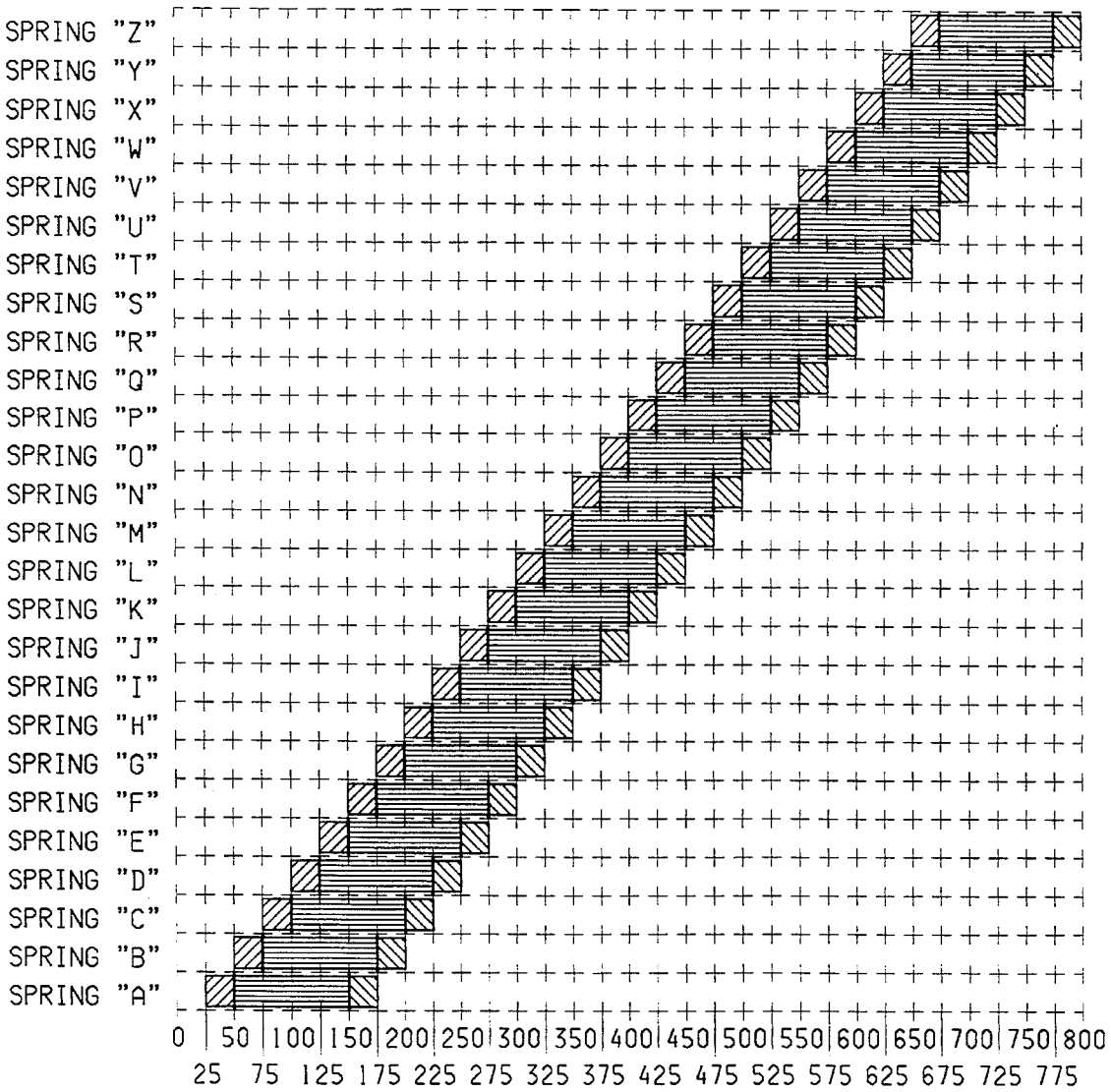
Figure 9:
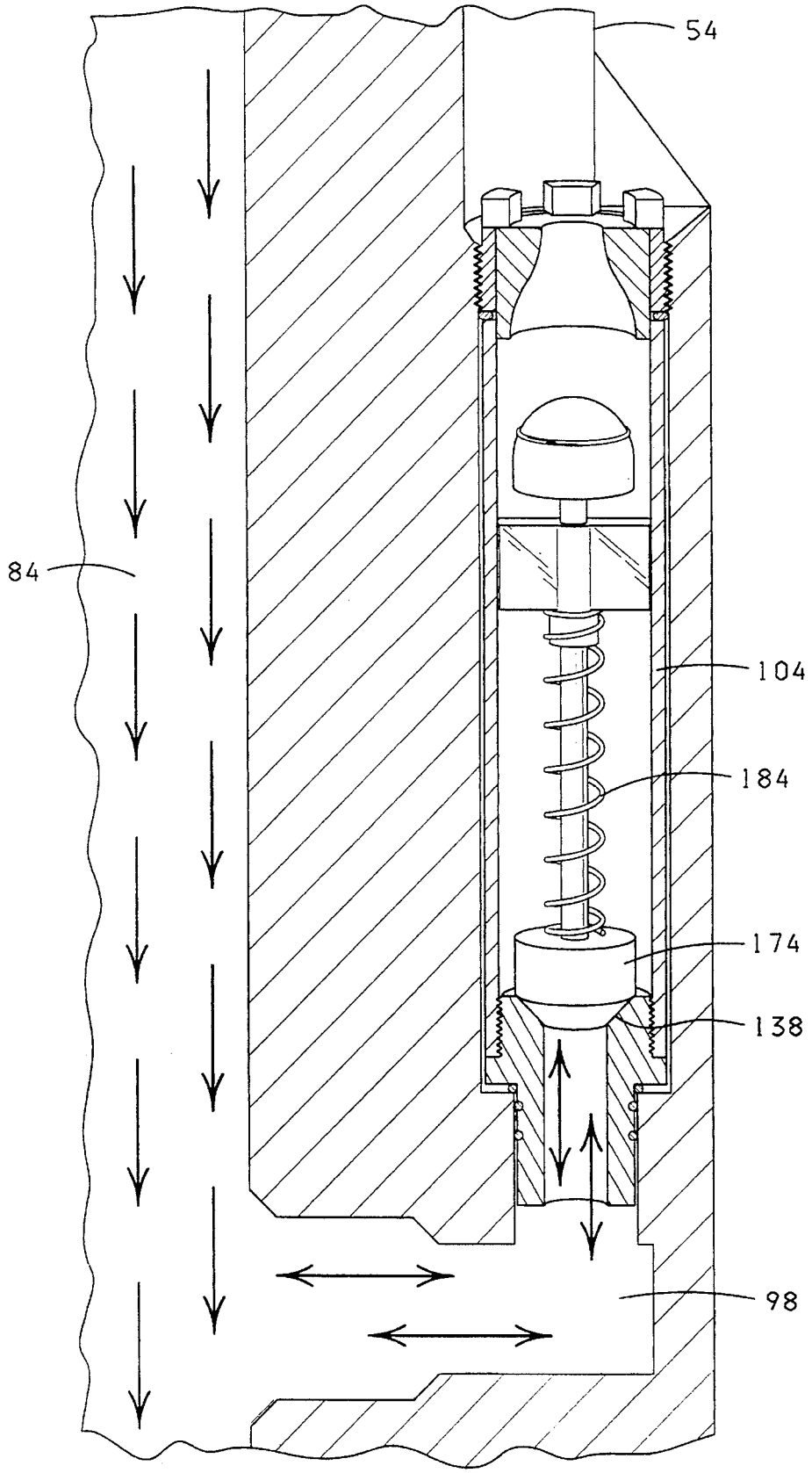
FIG. 9 shows a schematic transverse view of a bypass valve disposed in a conduit of the present invention, the bypass valve being in a closed position due to the seating of the lower valve against the lower valve seat, no air flowing through the bypass valve.
Figure 10:
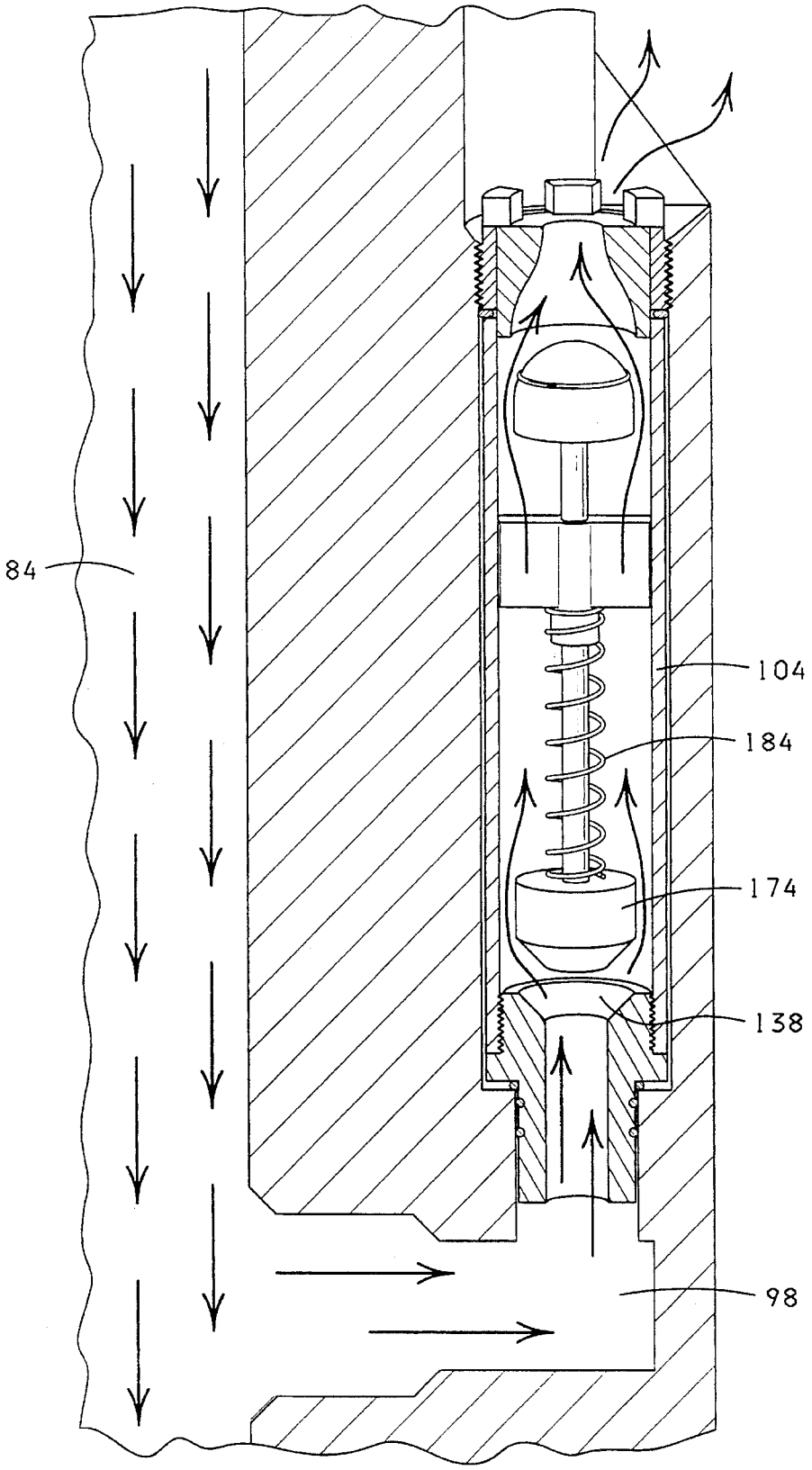
FIG. 10 shows a schematic transverse view of a bypass valve disposed in a conduit of the present invention, the bypass valve being in an open position due to the retraction of both the lower valve and the upper valve away from the lower valve seat and the upper valve seat, respectively, air flowing through the bypass valve.

In using the present pneumatic drilling chip removal system, and referring to FIG. 8, for example, "Spring A", when a minimal air pressure of 25–50 PSI occurs in the central passageway 84 and conduit 98, the lower valve 174 normally seated against the valve seat 138 in a closed position, (FIG. 9) will be displaced from the lower valve seat 138 against the restoring pressure of the coil spring 184 opening the bypass valve 104 to air flow from the central passageway 84 to the annulus 25. Between air pressure of about 50–150 PSI, both the lower valve 174 and the upper valve 173 will remain open, permitting continued air flow from the central passageway 84 through the conduit 98 and bypass valve 104 into the annulus 25, as shown in FIG. 10.

Figure 11:
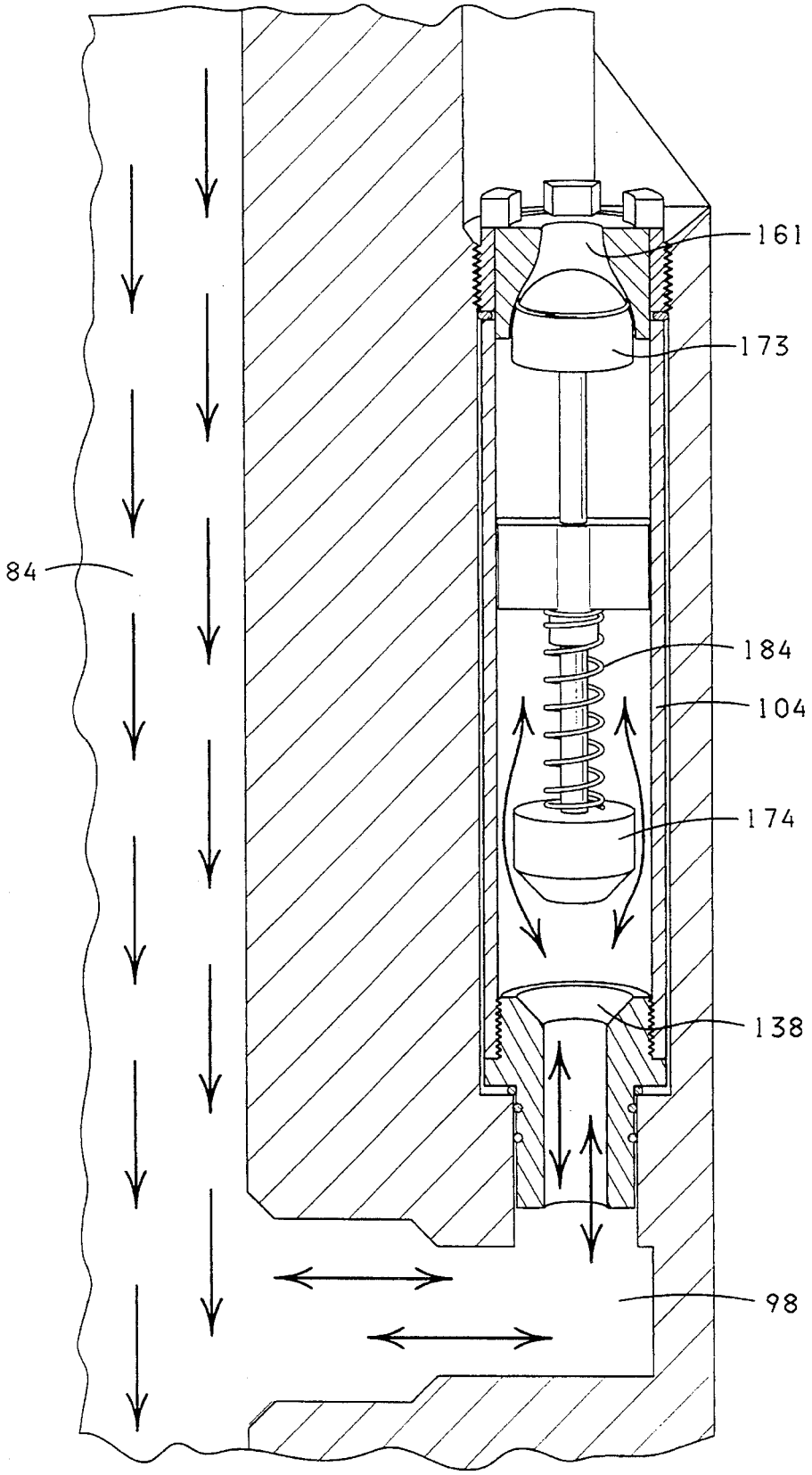
FIG. 11 shows a schematic transverse view of a bypass valve disposed in a conduit of the present invention, the bypass valve being in a closed position due to the seating of the upper valve against the upper valve seat, no air flowing through the bypass valve.

When the air pressure within the central passageway 84 has reached about 200 PSI or above (FIG. 8), the air pressure will cause a further displacement of the upper valve 173. The pressure against the lower valve 174 and the coil spring 184 will cause the upper valve 173 to be urged into a contacting engagement against the upper valve seat 161, thereby closing the bypass valve 104 to the flow of air therethrough due to the resisting force of the coil spring 184 against the upper valve 173, as shown in FIG. 11.

With the closure of the upper valve 173, no air will flow through the bypass valve 104. Rather, the entire air flow will be directed through the central passageway 84 and into the plurality of air jets 93 in the drilling bit 38 for dispersal into the annulus 25. It will be appreciated that Spring B through Spring Z (FIG. 8) operate in a manner substantially similar as that described for Spring A, although Springs B through Z have differing pre-set ranges for opening and closing. It will be appreciated that this 150 PSI range illustrated in FIG. 8 may be expanded to a broader range (for example, but not by way of limitation, to 250 PSI) or reduced (for example, but not by way of limitation, to 50 PSI) by forming the coil spring 184 from material(s) having different tensile strengths.

Under normal drilling conditions, i.e., with an air pressure below about 25 PSI (again, using "Spring A" of FIG. 8 for example), if drilling chip 95 removal by way of an air stream injected into the central passageway 84 and ejected via the air jets 93 in the drilling bit 38 into the annulus 25 is satisfactory to remove drilling chips 95 from the annulus 25, no supplemental air flow will be permitted through the bypass valves 104. That is, the lower valve 174 will be seated against the lower valve seat 138 in a closed position in the entrance section 108, while the upper valve 173 will remain displaced, away from the upper valve seat 161, in an open position.

Figure 12:
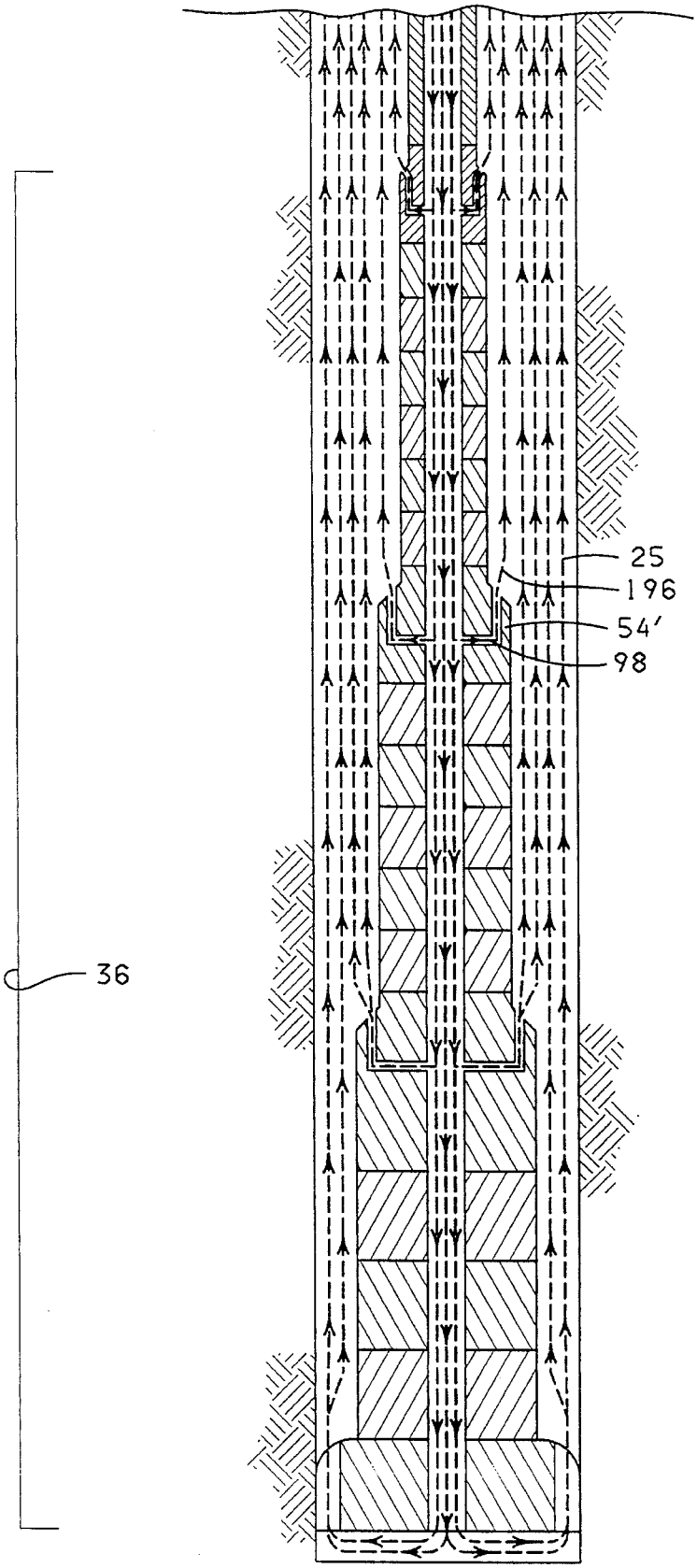
FIG. 12 shows a schematic transverse view of the lower drilling string and bottom hole assembly of the present invention, showing change over subs having conduits and bypass valves therein, the bypass valves open, thereby permitting supplementary air flow from said change over subs into the annulus.

When an air flow problem arises, or air flow is inadequate to remove the drilling chips 95 and drilling chips 95 become suspended in the annulus 25 or begin to block portions of the annulus 25, this condition will be reflected as a back pressure increase in both the annulus 25 and the central passageway 84, and will be recognized by operators at the surface 18. At a predetermined pressure (shown in FIG. 8, and continuing to use as an example "Spring A"), described previously, the bypass valve 104 will be actuated by displacement of the lower valve 174 away from the lower valve seat 138 in the entrance section 108, thereby admitting an air flow through the bypass valve 104 and into the annulus 25 (FIGS. 10 and 12). This air flow is introduced into the annulus 25 at the point where drilling chip accumulation will normally be concentrated, that is, in the critical lift areas 196 (only one critical lift area being designated 196). This triggering effect may occur in all bypass valves 104 contained within all change over subs 54 in the bottom hole assembly 36, at each of the critical lift areas 196 where drilling chip 95 accumulation may be occurring. The critical lift areas 196 will be subjected to the supplementary high pressure air flow, which will break up and/or disperse upward drilling chip 95 accumulations. Alternatively, bypass valves may be constructed to open at different times, in response to different ranges of pressures. Such variance may be accomplished by providing coil springs 184 of differing tensile strengths in different bypass valves 104, as shown in FIG. 8. In addition, various tensile strengths of the coil spring 184 may be attained by using different metals or materials, different thicknesses of materials, as well as combining, within a single coil spring 184, two different tensile strengths from one or more materials.

It will be understood that when the bypass valves 104 open, a drop of air pressure will be noted at the surface 18, especially pressure dropage in the central passageway 84. When such an air pressure drop in the central passageway 84 is noted by operators at the surface 18, steps can be taken to raise the central passageway 84 air pressure, so that sufficient air injection through the central passageway 84 and to the plurality of air jets 93 in the drilling bit 38 is maintained, thereby maintaining the upward dispersal of the drilling chips 95 from the area of drilled substrata 20 to the surface 18, as well as maintaining sufficient air pressure to maintain the bypass valves 104 in an open position, to aid in such dispersement. Supplementary air flow through the bypass valves 104 will be continued until the annulus 25 has been sufficiently cleared to achieve normalcy. At this time, air pressure within the central passageway 84 will drop, and the lower valve 174 in the bypass valve 104 will return to a closed position (FIG. 7).

It will be understood that supplementary air flow via the bypass valves 104 excess of a predetermined minimal pressure (FIG. 8) may be utilized to break up accumulations and suspensions of drilling chips 95 and to restore the normal drilling chip 95 discharge stream up through the annulus 25. If such measures are not successful in clearing a blockage of drilling chips 95 in the annulus 25 and restoring the operation to normalcy, another measure may be utilized to break up blockages in the annulus 25.

Referring to FIG. 13, it has been discovered that the best way to break up a large blockage of drilling chips 95 that substantially blocks the annulus 25 at a point above the drilling bit 38 is to direct all pressurized air through the central passageway and directly down through the air jets 93 in the drilling bit 38, thereby causing air pressure to build underneath the blockage. The increasing air pressure will eventually break up the blockage. In this instance, therefore, it is optimal to maintain the bypass valves 104 in a closed position. Therefore, the upper valve 173 is pre-set (FIG. 8 via the selected coil spring 184; Springs A through Z, respectively) via the selected coil spring 184 to function under the added air pressure such that the upper valve 173 will be moved adjacent to and into the sealing engagement with the upper valve seat 161, thereby closing the bypass valve 104 to airflow therethrough (FIG. 11). It will be appreciated that, just as bypass valves 104 in the bottom hole assembly 36 may all close at a pre-set high air pressure, such bypass valves permit adjustment of the coil spring 184, as previously described (FIG. 8), so that the bypass valves may close at various ranges of pressures. It will be understood that the air pressure will drop again upon disintegration of the blockage, and the bypass valves 104 will open if the air pressure within the central passageway falls within the pre-set range, thereby aiding in the upward dispersement of the drilling chips 95 from the annulus 25. Alternatively, or in conjunction with the latter described procedure, it will be appreciated by one of skill in the art that the sub-surface drilling equipment 14 may be raised and lowered, to break up the blockage.

Figure 14:
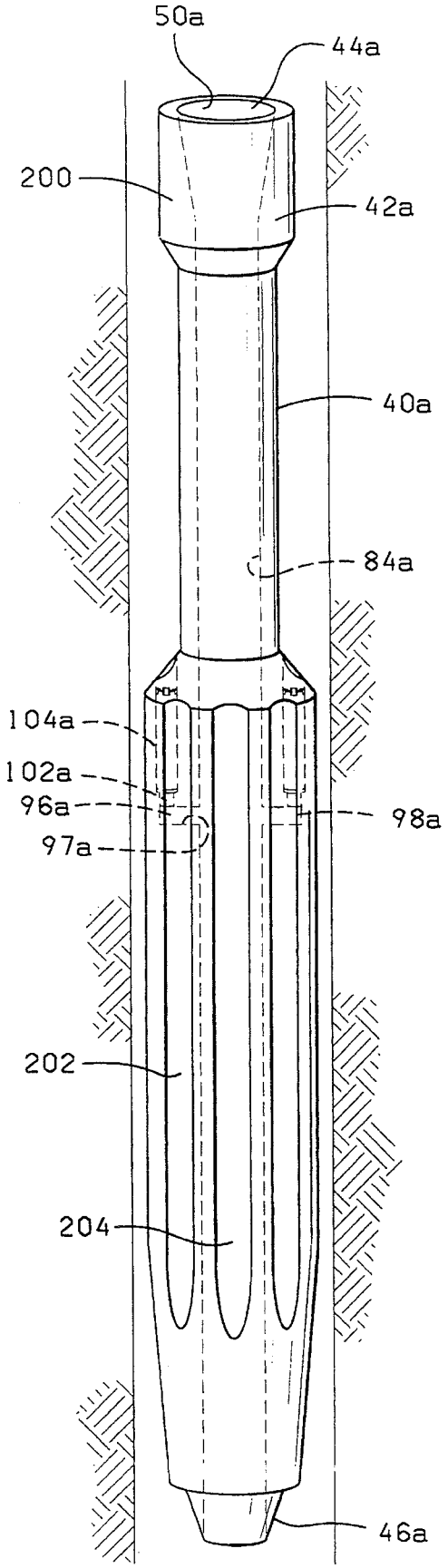
FIG. 14 shows a schematic perspective view of a modified drilling pipe.

The Embodiments and Methods of FIG. 14

Illustrated in FIG. 14 is a modified drill pipe 40*a* which is constructed exactly like the drill pipe 40 shown in FIGS. 1–2, and described in detail previously, except that the outer surface 42*a* has an upper conical neck 200 near the first end 44*a* of the drill pipe 40*a*, below which a lower conical neck 202 elongates into a generally cylindrical configuration which extends a distance downward. The lower conical neck 202 has a plurality of longitudinal grooves 204 (only one groove designated 204). The grooves 204 facilitate air flow, and reduce the occurrences of critical lift areas 196. The inner surface 50*a* of the drill pipe 40*a* has been modified in a manner which is substantially identical to the previously described internal modification of the change over sub 54. That is, the drill pipe 40*a* is intersected by an opening 96*a*, creating an inner surface 97*a* and an "L" shaped conduit 98*a* having an upper end 100*a* with grooves 101*a* (not shown) and a lower end 102*a*, the conduit 98*a* adapted to receiving a modified bypass valve 104*a*, the lower end 102*a* of the conduit 98*a* in pneumatic communication with the central passageway 84*a* of the drill pipe 40*a*. The conduit 98*a* is sized to receive a bypass valve 104*a*.

The modified bypass valve 104*a* and conduit 98*a* shown in the modified drill pipe 40*a* are identical to the bypass valve 104 and conduit 98 previously described in detail in change over subs 54, only the size of the bypass valve 104*a* and the conduit 98*a* have been scaled to conform to the size of the drill pipe 40*a*.

The method of use of the modified drill pipe 40*a* is substantially similar to that described previously for the change over subs 54. The primary difference is that the modified drill pipe 40*a* can be used in the drilling string 34, to facilitate drilling chip 95*a* removal in deep well bores 16.

Figure 15:
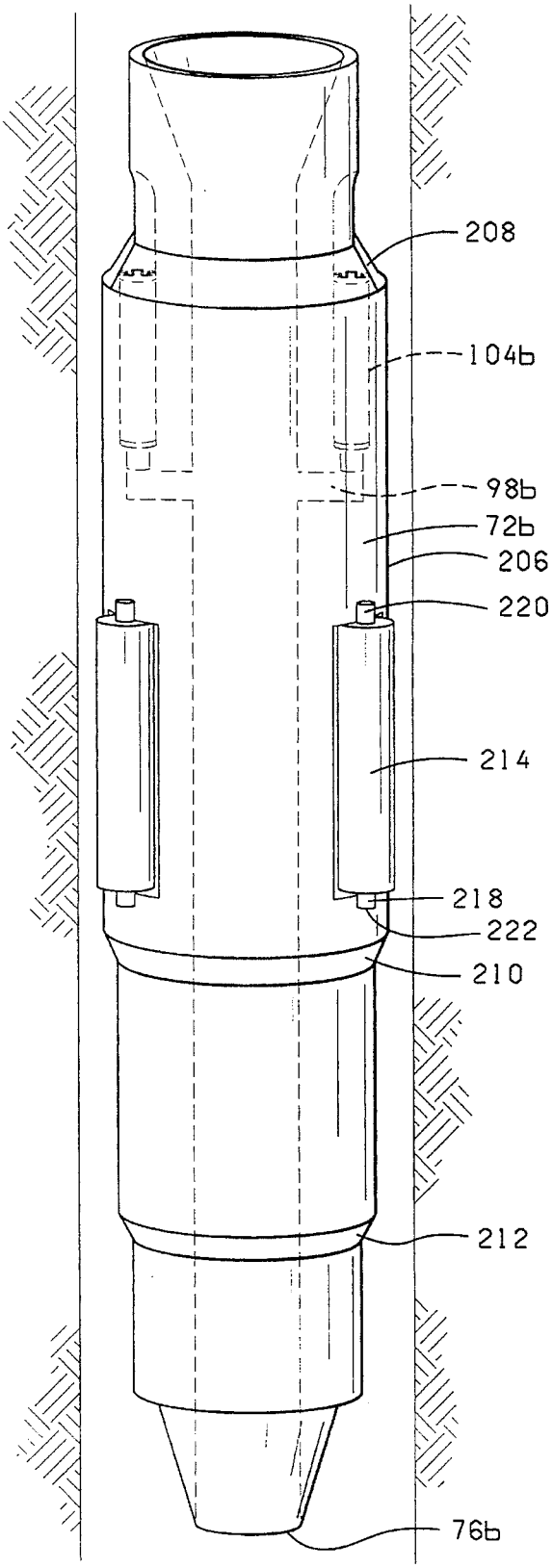
FIG. 15 shows a schematic perspective view of a modified roller reamer.
Figure 16:
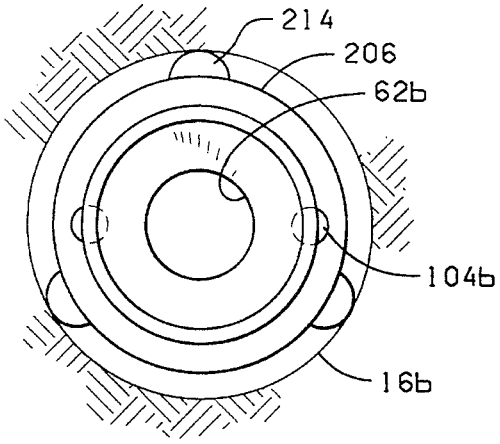
FIG. 16 shows a schematic top plan view of a modified roller reamer.
Figure 17:
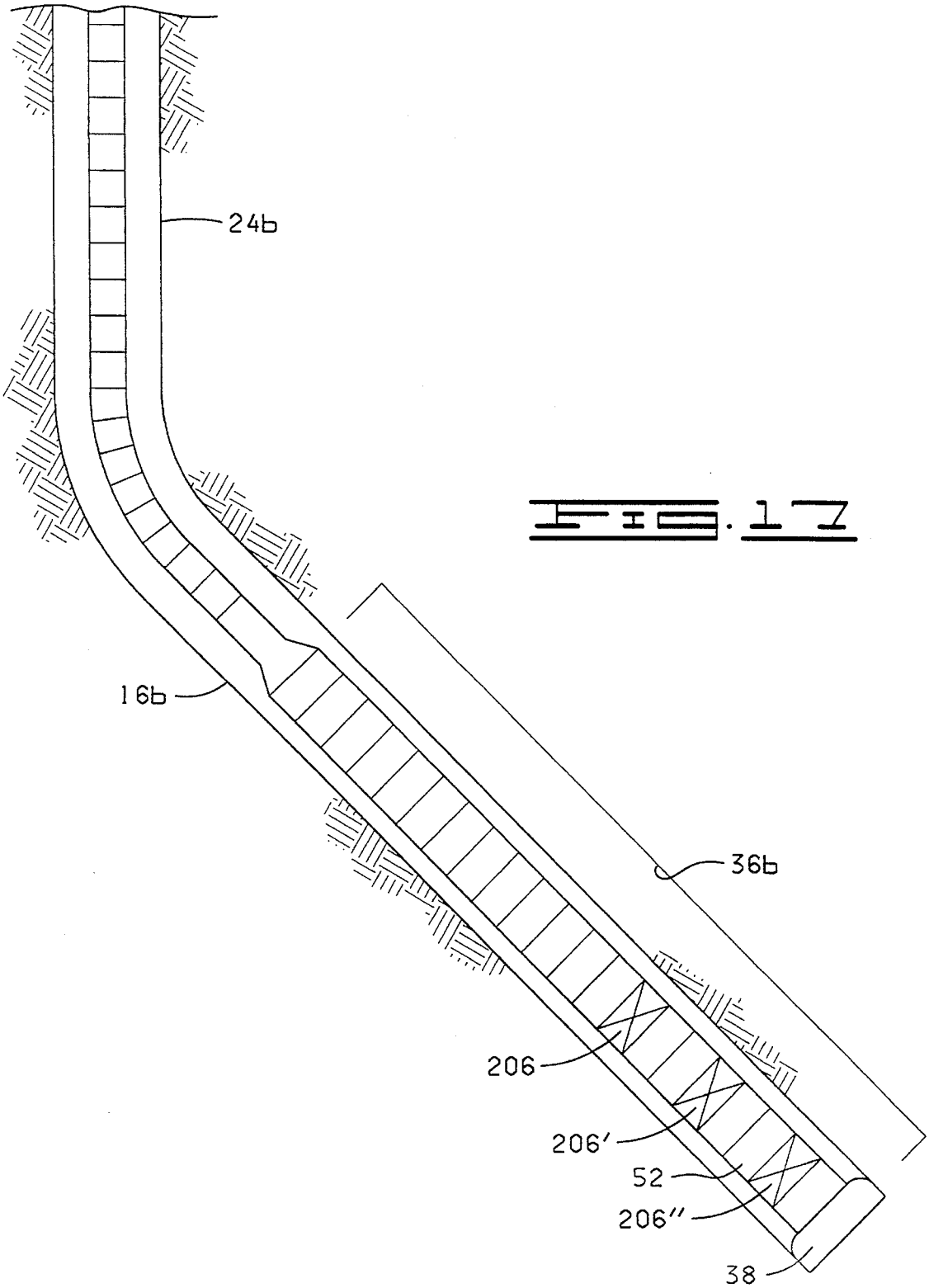
FIG. 17 shows a schematic side view of the sub-surface drilling equipment of the present invention, showing schematically the placement of modified roller reamers.

The Embodiments and Methods of FIGS. 15–17

Illustrated in FIGS. 15–17 is a modified type of change over sub 54 known in the art and referred to herein as a roller reamer 206 which is constructed exactly like the change over sub 54 shown in FIG. 14, and described in detail previously, except that the roller reamer 206 is not adapted to connect drill collars 52 of varying sizes. Rather, the roller reamer 206 is adapted to connect the drill collars 52*b* having the same outer diameter. Further, the roller reamer 206 has a narrow upper conical neck 208 which extends further along the length of the outer surface 72*b* of the roller reamer 206. The roller reamer also has a first lower conical neck 210, and a second lower conical neck 212 angling inward toward the lower end 76*b*. In addition, the roller reamer 206 has a plurality of rollers 214 (only one roller designated 214) attached to the outer surface 72*b* in a longitudinal manner, each roller 214 having a cylindrical shape and intersected by an opening 216 (not shown) extending therethrough sized to receive a rod 218. The rod 218 has a first end 220 and a second end 222 which connects each roller 214 to the outer surface 72*b* of the roller reamer 206 by being bolted thereto, welded thereto, or by any means known in the art. Each roller 214 is generally spaced an equal distance apart. The rollers 214 are used to maintain the correct diameter of a well bore 16 when an oblique angle of drilling is required, as shown in FIG. 17.

The modified bypass valve 104*b* and conduit 98*b* shown in the roller reamer 206 are identical to the bypass valve 104 and conduit 98 previously described in detail for change over subs 54, only the size of the bypass valve 104*b* and the conduit 98*b* have been scaled to conform to the size of the roller reamer 206.

Turning to the method of use, as shown schematically in FIG. 17, a roller reamer 206 is utilized in drilling oblique angle well bores 16. The bowing of the drill collars 52 are due to gravity and the desired angle of the well bore 16, and thereby affect the angle of drilling, and the drilling operation as a whole. When the sidewalls 24*b* of the well bore 16*b* become warped, the drilling bit 38*b* has a tendency to turn upward, and drill back toward the surface 18*b*. Roller reamers 206 (schematically shown and designated for purposes of illustration only as first roller reamer 206, second roller reamer 206', and third roller reamer 206") are utilized to interconnect drill collars 52 and to maintaining proper diameter and angle of the well bore 16, so that the drilling operation may progress properly toward the subterranean liquid or gas reservoirs targeted.

The roller reamers 206 described herein will perform their traditional function, and will perform, in a pneumatic drilling chip removal system, in a manner identical to that previously shown and described for change over subs 54, to assist in the pneumatic removal of drilling chips 95 from the annulus 25.

Figure 18:
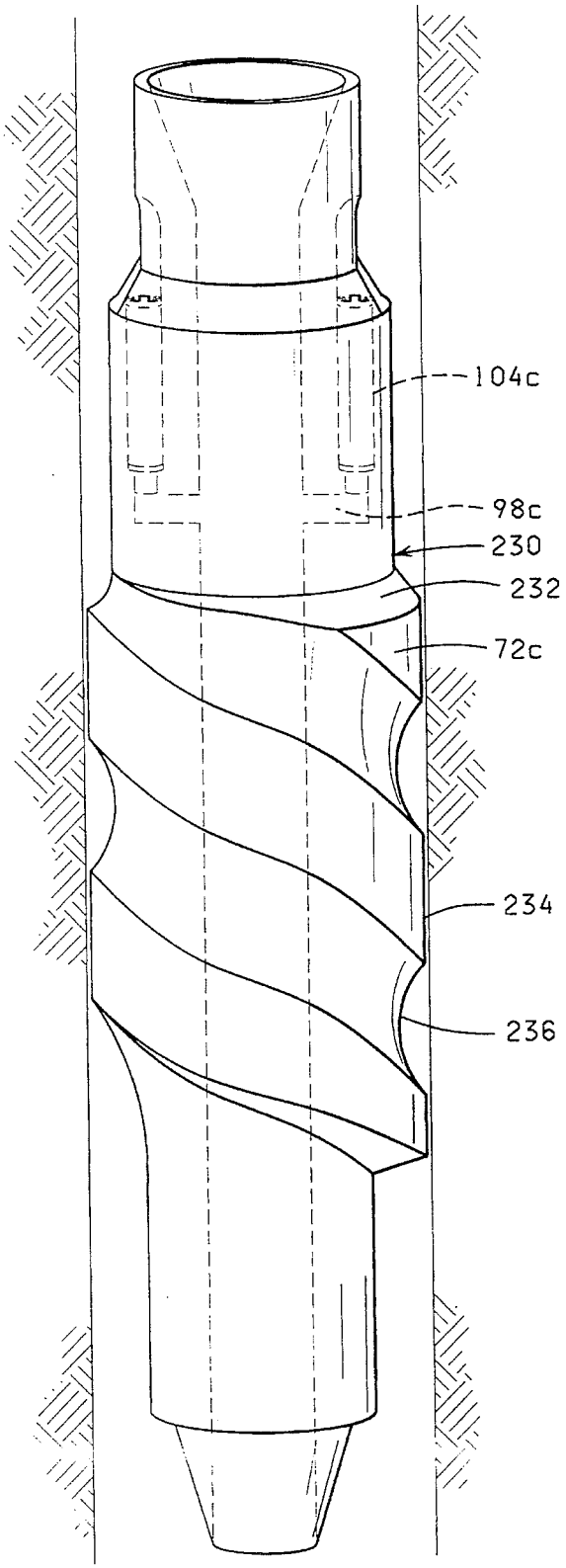
FIG. 18 shows a schematic perspective view of a modified blade stabilizer.
Figure 19:
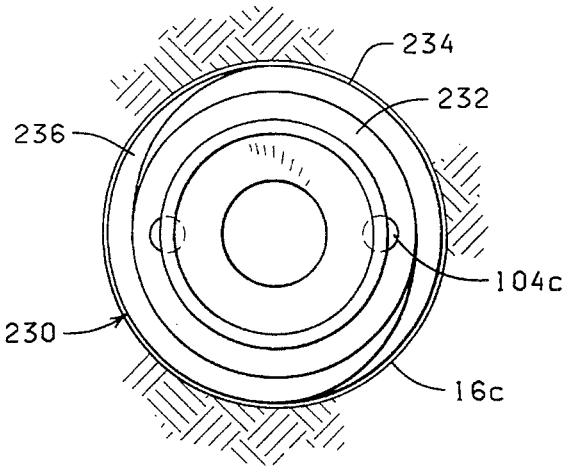
FIG. 19 shows a schematic top plan view of a modified blade stabilizer.
Figure 20:
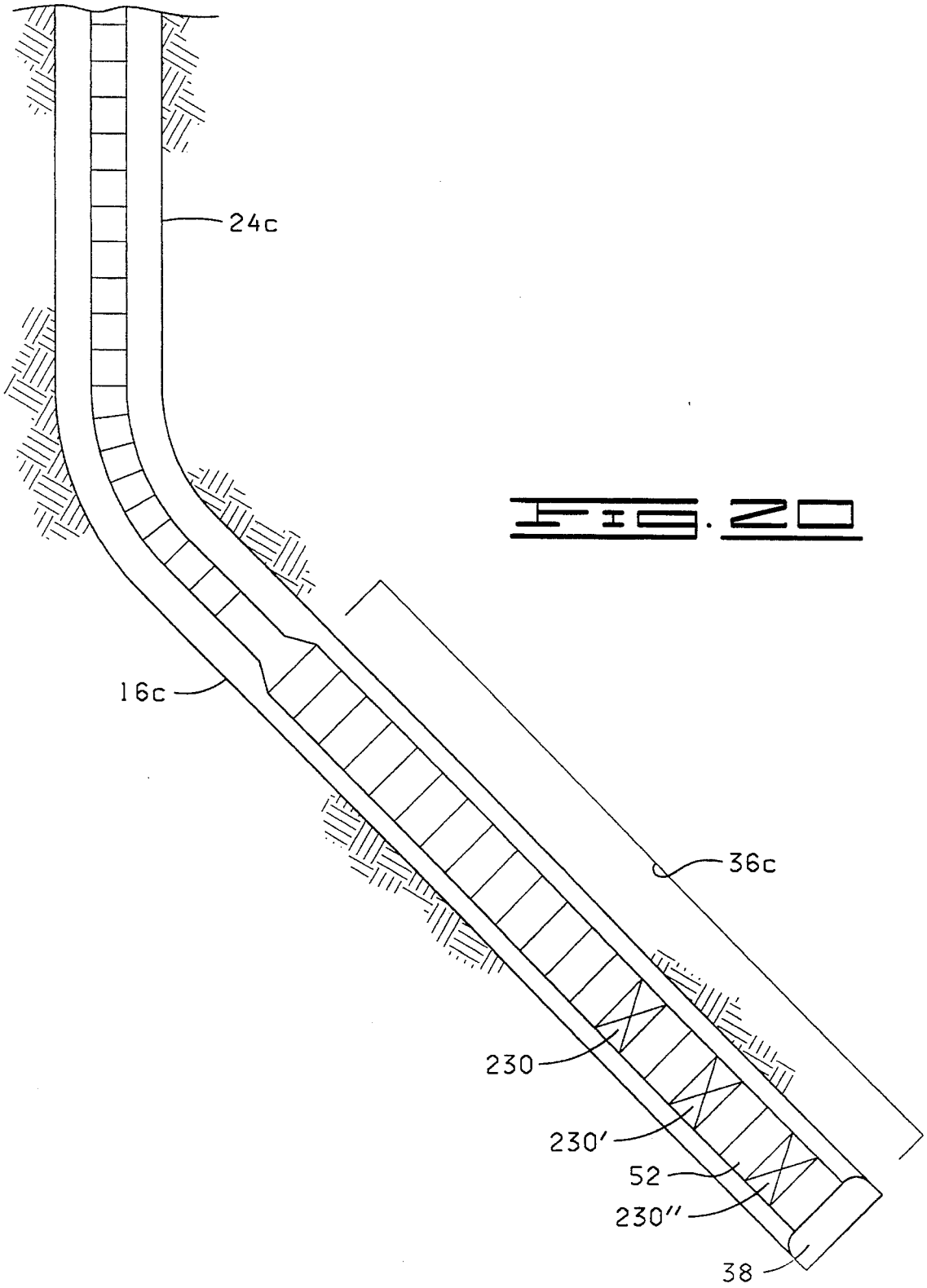
FIG. 20 shows a schematic side view of the sub-surface drilling equipment of the present invention, showing schematically the placement of modified blade stabilizers.

The Embodiments and Methods of FIGS. 18–20

Illustrated in FIGS. 18–20 is a modified type of change over sub 54 known in the art and referred to herein as a blade stabilizer 230 which is constructed exactly like the change over sub 54 shown in FIGS. 1–4, and described in detail previously, except that the blade stabilizer 230 is not adapted to connect drill collars 52 of varying sizes. Rather, the blade stabilizer 230 is adapted to connect to drill collars 52 having the same outer diameter. Further, the blade stabilizer 230 has a second partial conical neck 232. In addition, the blade stabilizer 230 has a spiralling blade section 234 and a spiralling passageway section 236 on the outer surface 72*c* of the blade stabilizer 230. The spiralling blade section 234 and the spiralling passageway section 236 develop and maintain the correct diameter of a well bore 16 (in a manner substantially similar to the roller reamer 206, described above) when oblique angles of drilling are required, as shown schematically in FIG. 20.

The modified bypass valve 104*c* and conduit 98*c* shown in the blade stabilizer 230 are identical to the bypass valve 104 and conduit 98 previously described in detail in change over subs 54, only the size of the bypass valve 104*c* and the conduit 98*c* has been scaled to conform to the size of the blade stabilizer 230.

Turning to the method of use, a blade stabilizer 230 is used in the same or similar drilling operations as that illustrated in FIG. 20 and described in detail above for the roller reamer 206. (Schematically shown and designated for purposes of illustration only as first blade stabilizer 230, second blade stabilizer 230', and third blade stabilizer 230"). The blade stabilizer 230 will perform, in a pneumatic drilling chip removal system, in a manner identical to that previously described for change over subs 54, except that the drilling chips 95 will move upward through the spiralling passageway 236 and upward through the annulus 25 to be expelled.

Figure 21:
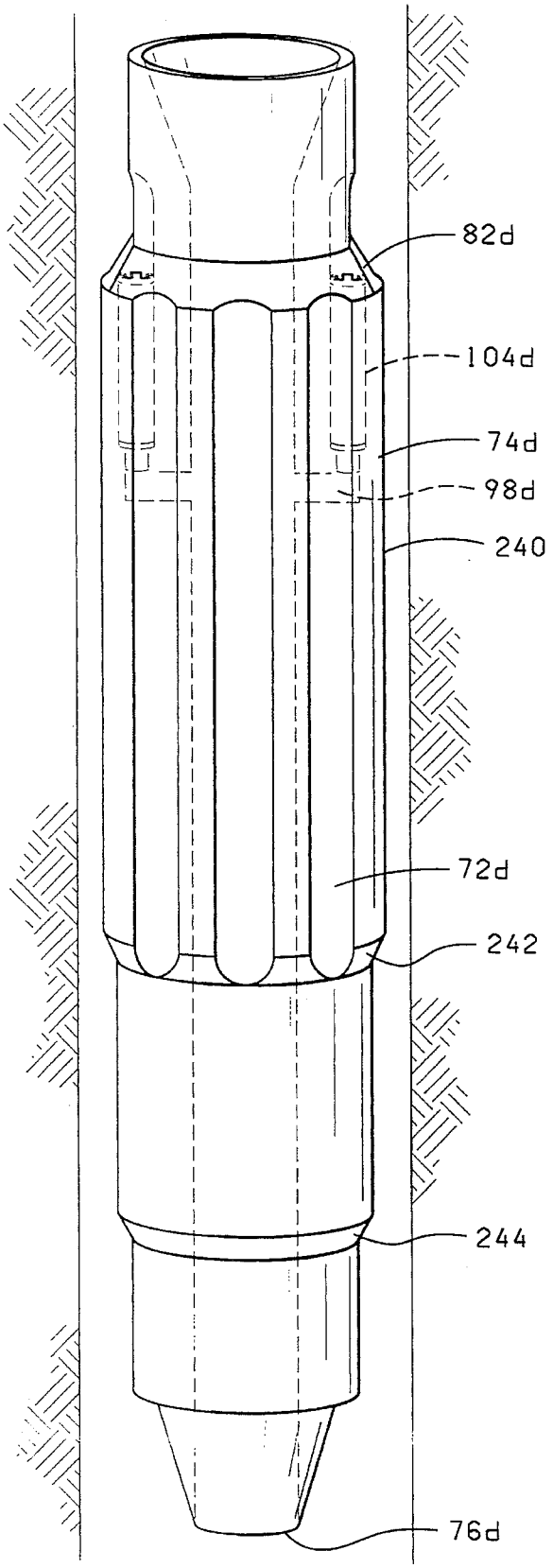
FIG. 21 shows a schematic perspective view of a modified blade stabilizer.
Figure 22:
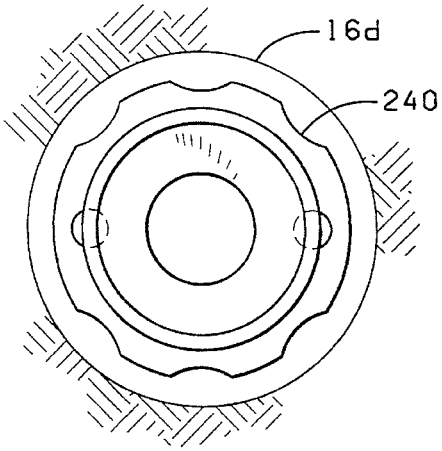
FIG. 22 shows a schematic top plan view of a modified blade stabilizer.

The Embodiments and Methods of FIGS. 21–22

Illustrated in FIGS. 21–22 is a modified change over sub 54*d* referred to as an adapter sub 240 which is constructed exactly like the change over sub 54 shown in FIGS. 1–4, and described in detail previously, except that the adapter sub 240 is not adapted to connect drill collars 52 of varying sizes. Rather, the adapter sub 240 is adapted to connect to standard drill pipe 40, standard drill collars 52, standard roller reamers, and/or standard blade stabilizers having the same outer diameter as the adapter sub 240. The adapter sub 240 has a narrower conical neck 81*d* near the upper end 74*d* of the adapter sub 240 and a first lower conical neck 242 and a second lower conical neck 244 near the lower end 76*d* of the adapter sub 240.

The modified bypass valve 104*d* and conduit 98*d* shown in the adapter sub 240 are identical to the bypass valve 104*d* and conduit 98*d* previously described in detail for change over subs 54, only the size of the bypass valve 104*d* and the conduit 98*d* has been scaled to conform to the size of the adapter sub 240.

Turning to the method of use, an adapter sub 240 is used in the same or similar drilling operations as that illustrated in FIGS. 1–2, 17 and 20 and shown and described in detail previously herein for drill pipe 40, change over subs 54, drill collars 52, roller reamers 206, and blade stabilizer 230, except that it is used in conjunction with the above named devices. The adapter sub 240 will perform, in a pneumatic drilling chip removal system, in a manner identical to that previously described for change over subs 54.

Changes may be made in the embodiments of the invention described herein or in parts or elements of the embodiments described herein or in the steps or in the sequence of steps of the methods described herein without departing from the spirit and scope of the invention as defined in the following claims.

What is claimed is:

1. A method for using pneumatic component for pneumatically removing drilling chips from an annulus of a well bore while forming the well bore in a substrate, the well bore having an upper end and a lower end, the well bore having said annulus capable of air flow therethrough, said pneumatic component comprising at least a portion of the sub-surface drilling equipment said sub-surface drilling equipment comprising a plurality of components and a drilling bit, said sub-surface drilling equipment extending from the upper end to the lower end of the well bore, said drilling bit contacting the lower end of the well bore thereby forming and deepening the well bore, the drilling bit having air jets therein to propel the drilling chips cut away at the lower end of the well bore upward in the annulus, a central passageway extending through the components and to the air jets in the drilling bit, said pneumatic component disposed above the drilling bit, said sub-surface drilling equipment connected to surface drilling equipment situated above the well bore, said surface drilling equipment having a pressurized air the method comprising the steps of:

providing a pneumatic component having a first end, a second end, an outer surface and an opening therethrough forming an inner surface, the opening comprising a central passageway therethrough, said central passageway in pneumatic communication with an opening extending from the central passageway through the outer surface of the component, a substantial portion of said opening being disposed substantially parallel to the central passageway, said opening forming a pneumatic conduit;

providing a dual valve, said dual valve having selected components which permit control of air flow in specific drilling conditions when the dual valve is disposed in the pneumatic conduit of the pneumatic component, said dual valve disposed in the pneumatic conduit of the pneumatic component;

connecting the pressurized air source to the central passageway in the sub-surface drilling equipment, the air being communicated via the central passageway of the components to the air jets in the drilling bit, said air expelled upward into the annulus the air carrying drilling chips upward in the annulus toward the surface drilling equipment; and controlling air flow through the conduit of the pneumatic component via the dual valve disposed therein, the dual valve disposed substantially parallel to the central passageway, the dual valve permitting selective pneumatic communication of air flow from the central passageway through the dual valve and the conduit to the annulus, air exiting into the annulus substantially parallel to the central passageway thereby creating supplemental air flow into the annulus for propelling drilling chips upward in the annulus thereby facilitating removal of the drilling chips from the annulus when the central passageway of the sub-surface drilling equipment and the conduit of the pneumatic component are in pneumatic communication with an air source having pressures within pre-selected ranges.

2. The method of 1 wherein in the step of controlling air flow through the conduit of the pneumatic component via the dual valve, said step further comprises providing the dual valve comprising a cylindrical hollow sleeve, a lower valve seat having an opening therethrough, an upper valve seat having an opening therethrough, a valve stem having a lower valve connected at one end thereof and an upper valve at the opposite end thereof, the valve stem slideably engaging a guide block, said guide block being rigidly engaged to the sleeve, a coil spring being disposed about a portion of the valve stem between the lower valve and the guide block, said coil spring permitting the lower valve to become displaced away from the lower valve seat, while causing the upper valve also to be displaced away from the upper valve seat, thereby permitting air flow from the central passageway through the conduit and into the annulus in response to a specific air pressure range against the lower valve.

3. The method of claim 2, wherein the coil spring causes the lower valve to become displaced away from the lower valve seat, while causing the upper valve to seat against the upper valve seat, thereby preventing air flow from the central passageway through the conduit and into the annulus in response to a specific air pressure range against the lower valve.

4. A method for using a pneumatic component for pneumatically removing drilling chips from an annulus of a well bore while forming the well bore in a substrate, the well bore having an upper end and a lower end, the well bore having said annulus capable of air flow therethrough, said pneumatic component comprising at least a portion of the sub-surface drilling equipment, said sub-surface drilling equipment comprising a plurality of components and a drilling bit, said sub-surface drilling equipment extending from the upper end to the lower end of the well bore, said drilling bit contacting the lower end of the well bore thereby forming and deepening the well bore, the drilling bit having air jets therein to propel the drilling chips cut away at the lower end of the well bore upward in the annulus, a central passageway extending through the components and to the air jets in the drilling bit, said pneumatic component disposed above the drilling bit, said sub-surface drilling equipment connected to surface drilling equipment situated above the well bore, said surface drilling equipment having a pressurized air source, the method comprising the steps of:

providing a pneumatic component comprising a change over sub having a first end, a second end, an outer surface and an opening therethrough forming an inner surface, the first end connected to a component of the sub-surface drilling equipment, the second end connected to another component of the sub-surface drilling equipment, the opening in the change over sub comprising a central passageway therethrough, said central passageway in pneumatic communication with an opening extending from the central passageway through the outer surface of the component, a substantial portion of said opening being disposed substantially parallel to the central passageway, said opening forming a pneumatic conduit;

providing a dual valve, said dual valve having selected components which permit control of air flow in specific drilling conditions when the dual valve is disposed in the pneumatic conduit of the change over sub, said dual valve disposed in the pneumatic conduit of the change over sub;

connecting the pressurized air source to the central passageway in the sub-surface drilling equipment, the air being communicated via the central passageway of the components to the air jets in the drilling bit, said air expelled upward into the annulus, the air carrying drilling chips upward in the annulus toward the surface drilling equipment; and controlling air flow through the conduit of the change over sub via the dual valve disposed therein, the dual valve disposed substantially parallel to the central passageway, the dual valve permitting selective pneumatic communication of air flow from the central passageway through the dual valve and the conduit to the annulus, air exiting into the annulus substantially parallel to the central passageway thereby creating supplemental air flow into the annulus for propelling drilling chips upward in the annulus thereby facilitating removal of the drilling chips from the annulus when the central passageway of the sub-surface drilling equipment and the conduit of the change over sub are in pneumatic communication with an air source having air pressures within pre-selected ranges.

5. The method of 4 wherein in the step of controlling air flow through the conduit of the change over sub via the dual valve, said step further comprises providing the dual valve comprising a cylindrical hollow sleeve, a lower valve seat having an opening therethrough, an upper valve seat having an opening therethrough, a valve stem having a lower valve connected at one end thereof and an upper valve at the opposite end thereof, the valve stem slideably engaging a guide block, said guide block being rigidly engaged to the sleeve, a coil spring being disposed about a portion of the valve stem between the lower valve and the guide block, said coil spring permitting the lower valve to become displaced away from the lower valve seat, while causing the upper valve also to be displaced away from the upper valve seat, thereby permitting air flow from the central passageway through the conduit and into the annulus in response to a specific air pressure range against the lower valve.

6. The method of claim 5, wherein the coil spring causes the lower valve to become displaced away from the lower valve seat, while causing the upper valve to seat against the upper valve seat, thereby preventing air flow from the central passageway through the conduit and into the annulus in response to a specific air pressure range against the lower valve.

7. A method for using a pneumatic component for pneumatically removing drilling chips from an annulus of a well bore while forming the well bore in a substrate, the well bore having an upper end and a lower end, the well bore having said annulus capable of air flow therethrough, said pneumatic component comprising at least a portion of the sub-surface drilling equipment, said sub-surface drilling equipment comprising a plurality of components and a drilling bit, said sub-surface drilling equipment extending from the upper end to the lower end of the well bore, said drilling bit contacting the lower end of the well bore thereby forming and deepening the well bore, the drilling bit having air jets therein to propel the drilling chips cut away at the lower end of the well bore upward in the annulus, a central passageway extending through the components and to the air jets in the drilling bit, said pneumatic component disposed above the drilling bit, said sub-surface drilling equipment connected to surface drilling equipment situated above the well bore, said surface drilling equipment having a pressurized air source, the method comprising the steps of:

providing a pneumatic component comprising a roller reamer having a first end, a second end, an outer surface and an opening therethrough forming an inner surface, the first end connected to a component of the sub-surface drilling equipment, the second end connected to another component of the sub-surface drilling equipment, the opening in the roller reamer comprising a central passageway therethrough, said central passageway in pneumatic communication with an opening extending from the central passageway through the outer surface of the component, a substantial portion of said opening being disposed substantially parallel to the central passageway, said opening forming a pneumatic conduit;

providing a dual valve, said dual valve having selected components which permit control of air flow in specific drilling conditions when the dual valve is disposed in the pneumatic conduit of the roller reamer, said dual valve disposed in the pneumatic conduit of the roller reamer;

connecting the pressurized air source to the central passageway in the sub-surface drilling equipment, the air being communicated via the central passageway of the components to the air jets in the drilling bit, said air expelled upward into the annulus, the air carrying drilling chips upward in the annulus toward the surface drilling equipment; and controlling air flow through the conduit of the roller reamer via the dual valve disposed therein, the dual valve disposed substantially parallel to the central passageway, the dual valve permitting selective pneumatic communication of air flow from the central passageway through the dual valve and the conduit to the annulus, air exiting into the annulus substantially parallel to the central passageway thereby creating supplemental air flow into the annulus for propelling drilling chips upward in the annulus thereby facilitating removal of the drilling chips from the annulus when the central passageway of the sub-surface drilling equipment and the conduit of the roller reamer are in pneumatic communication with an air source having air pressures within pre-selected ranges.

8. The method of 7 wherein in the step of controlling air flow through the conduit of the roller reamer via the dual valve, said step further comprises providing the dual valve comprising a cylindrical hollow sleeve, a lower valve seat having an opening therethrough, an upper valve seat having an opening therethrough, a valve stem having a lower valve connected at one end thereof and an upper valve at the opposite end thereof, the valve stem slideably engaging a guide block, said guide block being rigidly engaged to the sleeve, a coil, spring being disposed about a portion of the valve stem between the lower valve and the guide block, said coil spring permitting the lower valve to become displaced away from the lower valve seat, while causing the upper valve also to be displaced away from the upper valve seat, thereby permitting air flow from the central passageway through the conduit and into the annulus in response to a specific air pressure range against the lower valve.

9. The method of claim 8, wherein the coil spring causes the lower valve to become displaced away from the lower valve seat, while causing the upper valve to seat against the upper valve seat, thereby preventing air flow from the central passageway through the conduit and into the annulus in response to a specific air pressure range against the lower valve.

10. A method for using a pneumatic component for pneumatically removing drilling chips from an annulus of a well bore while forming the well bore in a substrate, the well bore having an upper end and a lower end, the well bore having said annulus capable of air flow therethrough, said pneumatic component comprising at least a portion of the sub-surface drilling equipment, said sub-surface drilling equipment comprising a plurality of components and a drilling bit, said sub-surface drilling equipment extending from the upper end to the lower end of the well bore, said drilling bit contacting the lower end of the well bore thereby forming and deepening the well bore, the drilling bit having air jets therein to propel the drilling chips cut away at the lower end of the well bore upward in the annulus, a central passageway extending through the components and to the air jets in the drilling bit, said pneumatic component disposed above the drilling bit, said sub-surface drilling equipment connected to surface drilling equipment situated above the well bore, said surface drilling equipment having a pressurized air source, the method comprising the steps of:

providing a pneumatic component comprising a blade stabilizer having a first end, a second end, an outer surface and an opening therethrough forming an inner surface, the first end connected to a component of the sub-surface drilling equipment, the second end connected to another component of the sub-surface drilling equipment, the opening in the blade adapter comprising a central passageway therethrough, said central passageway in pneumatic communication with an opening extending from the central passageway through the outer surface of the component, a substantial portion of said opening being disposed substantially parallel to the central passageway, said opening forming a pneumatic a conduit;

providing a dual valve, said dual valve having selected components which permit control of air flow in specific drilling conditions when the dual valve is disposed in the pneumatic conduit of the blade stabilizer, said dual valve disposed in the pneumatic conduit of the blade stabilizer;

connecting the pressurized air source to the central passageway in the sub-surface drilling equipment, the air being communicated via the central passageway of the components to the air jets in the drilling bit, said air expelled upward into the annulus, the air carrying drilling chips upward in the annulus toward the surface drilling equipment; and controlling air flow through the conduit of the blade stabilizer via the dual valve disposed therein, the dual valve disposed substantially parallel to the central passageway, the dual valve permitting selective pneumatic communication of air flow from the central passageway through the dual valve and the conduit to the annulus, air exiting into the annulus substantially parallel to the central passageway thereby creating supplemental air flow into the annulus for propelling drilling chips upward in the annulus thereby facilitating removal of the drilling chips from the annulus when the central passageway of the sub-surface drilling equipment and the conduit of the blade stabilizer are in pneumatic communication with an air source having air pressures within preselected ranges.

11. The method of 10 wherein in the step of controlling air flow through the conduit of the blade stabilizer via the dual valve, said step further comprises providing the dual valve comprising a cylindrical hollow sleeve, a lower valve seat having an opening therethrough, an upper valve seat having an opening therethrough, a valve stem having a lower valve connected at one end thereof and an upper valve at the opposite end thereof, the valve stem slideably engaging a guide block, said guide block being rigidly engaged to the sleeve, a coil spring being disposed about a portion of the valve stem between the lower valve and the guide block, said coil spring permitting the lower valve to become displaced away from the lower valve seat, while causing the upper valve also to be displaced away from the upper valve seat, thereby permitting air flow from the central passageway through the conduit and into the annulus in response to a specific air pressure range against the lower valve.

12. The method of claim 11, wherein the coil spring causes the lower valve to become displaced away from the lower valve seat, while causing the upper valve to seat against the upper valve seat, thereby preventing air flow from the central passageway through the conduit and into the annulus in response to a specific air pressure range against the lower valve.

13. A method for using a pneumatic component for pneumatically removing drilling chips from an annulus of a well bore while forming the well bore in a substrate, the well bore having an upper end and a lower end, the well bore having said annulus capable of air flow therethrough, said pneumatic component comprising at least a portion of the sub-surface drilling equipment, said sub-surface drilling equipment comprising a plurality of components and a drilling bit, said sub-surface drilling equipment extending from the upper end to the lower end of the well bore, said drilling bit contacting the lower end of the well bore thereby forming and deepening the well bore, the drilling bit having air jets therein to propel the drilling chips cut away at the lower end of the well bore upward in the annulus, a central passageway extending through the components and to the air jets in the drilling bit, said pneumatic component disposed above the drilling bit, said sub-surface drilling equipment connected to surface drilling equipment situated above the well bore, said surface drilling equipment having a pressurized air source, the method comprising the steps of:

providing a pneumatic component comprising a drill pipe having a first end, a second end, an outer surface and an opening therethrough forming an inner surface, the first end connected to a component of the sub-surface drilling equipment, the second end connected to another component of the sub-surface drilling equipment, the opening in the drill pipe comprising a central passageway therethrough, said central passageway in pneumatic communication with an opening extending from the central passageway through the outer surface of the component, a substantial portion of said opening being disposed substantially parallel to the central passageway, said opening forming a pneumatic a conduit;

providing a dual valve, said dual valve having selected components which permit control of air flow in specific drilling conditions when the dual valve is disposed in the pneumatic conduit of the drill pipe, said dual valve disposed in the pneumatic conduit of the drilling pipe;

connecting the pressurized air source to the central passageway in the sub-surface drilling equipment, the air being communicated via the central passageway of the components to the air jets in the drilling bit, said air expelled upward into the annulus, the air carrying drilling chips upward in the annulus toward the surface drilling equipment; and controlling air flow through the conduit of the drill pipe via the dual valve disposed therein, the dual valve disposed substantially parallel to the central passageway, the dual valve permitting selective pneumatic communication of air flow from the central passageway through the dual valve and the conduit to the annulus, air exiting into the annulus substantially parallel to the central passageway thereby creating supplemental air flow into the annulus for propelling drilling chips upward in the annulus thereby facilitating removal of the drilling chips from the annulus when the central passageway of the sub-surface drilling equipment and the conduit of the drill pipe are in pneumatic communication with an air source having air pressures within pre-selected ranges.

14. The method of 13 wherein in the step of controlling air flow through the conduit of the drill pipe via the dual valve, said step further comprises providing the dual valve comprising a cylindrical hollow sleeve, a lower valve seat having an opening therethrough, an upper valve seat having an opening therethrough, a valve stem having a lower valve connected at one end thereof and an upper valve at the opposite end thereof, the valve stem slideably engaging a guide block, said guide block being rigidly engaged to the sleeve, a coil spring being disposed about a portion of the valve stem between the lower valve and the guide block, said coil spring permitting the lower valve to become displaced away from the lower valve seat, while causing the upper valve also to be displaced away from the upper valve seat, thereby permitting air flow from the central passageway through the conduit and into the annulus in response to a specific air pressure range against the lower valve.

15. The method of claim 14, wherein the coil spring causes the lower valve to become displaced away from the lower valve seat, while causing the upper valve to seat against the upper valve seat, thereby preventing air flow from the central passageway through the conduit and into the annulus in response to a specific air pressure range against the lower valve.

16. A method for using a pneumatic component for pneumatically removing drilling chips from an annulus of a well bore while forming the well bore in a substrate, the well bore having an upper end and a lower end, the well bore having said annulus capable of air flow therethrough, said pneumatic component comprising at least a portion of the sub-surface drilling equipment, said sub-surface drilling equipment comprising a plurality of components and a drilling bit, said sub-surface drilling equipment extending from the upper end to the lower end of the well bore, said drilling bit contacting the lower end of the well bore thereby forming and deepening the well bore, the drilling bit having air jets therein to propel the drilling chips cut away at the lower end of the well bore upward in the annulus, a central passageway extending through the components and to the air jets in the drilling bit, said pneumatic component disposed above the drilling bit, said sub-surface drilling equipment connected to surface drilling equipment situated above the well bore, said surface drilling equipment having a pressurized air source, the method comprising the steps of:

providing a pneumatic component comprising an adapter having a first end, a second end, an outer surface and an opening therethrough forming an inner surface, the first end connected to a component of the sub-surface drilling equipment, the second end connected to another component of the sub-surface drilling equipment, the opening in the adapter comprising a central passageway therethrough, said central passageway in pneumatic communication with an opening extending from the central passageway through the outer surface of the component, a substantial portion of said opening being disposed substantially parallel to the central passageway, said opening forming a pneumatic a conduit;

providing a dual valve, said dual valve having selected components which permit control of air flow in specific drilling conditions when the dual valve is disposed in the pneumatic conduit of the adapter, said dual valve disposed in the pneumatic conduit of the adapter;

connecting the pressurized air source to the central passageway in the sub-surface drilling equipment, the air being communicated via the central passageway of the components to the air jets in the drilling bit, said air expelled upward into the annulus, the air carrying drilling chips upward in the annulus toward the surface drilling equipment; and controlling air flow through the conduit of the adapter via the dual valve disposed therein, the dual valve disposed substantially parallel to the central passageway, the dual valve permitting selective pneumatic communication of air flow from the central passageway through the dual valve and the conduit to the annulus, air exiting into the annulus substantially parallel to the central passageway thereby creating supplemental air flow into the annulus for propelling drilling chips upward in the annulus thereby facilitating removal of the drilling chips from the annulus when the central passageway of the sub-surface drilling equipment and the conduit of the adapter are in pneumatic communication with an air source having air pressures within pre-selected ranges.

17. The method of 16 wherein in the step of controlling air flow through the conduit of the adapter via the dual valve, said step further comprises providing the dual valve comprising a cylindrical hollow sleeve, a lower valve seat having an opening therethrough, an upper valve seat having an opening therethrough, a valve stem having a lower valve connected at one end thereof and an upper valve at the opposite end thereof, the valve stem slideably engaging a guide block, said guide block being rigidly engaged to the sleeve, a coil spring being disposed about a portion of the valve stem between the lower valve and the guide block, said coil spring permitting the lower valve to become displaced away from the lower valve seat, while causing the upper valve also to be displaced away from the upper valve seat, thereby permitting air flow from the central passageway through the conduit and into the annulus in response to a specific air pressure range against the lower valve.

18. The method of claim 17, wherein the coil spring causes the lower valve to become displaced away from the lower valve seat, while causing the upper valve to seat against the upper valve seat, thereby preventing air flow from the central passageway through the conduit and into the annulus in response to a specific air pressure range against the lower valve.

* * * * *

UNITED STATES PATENT AND TRADEMARK OFFICE

CERTIFICATE OF CORRECTION

PATENT NO. : 5,584,352

DATED : December 17, 1996

INVENTOR(S) : Roger L. Beavers

It is certified that error appears in the above-identified patent and that said Letters Patent is hereby corrected as shown below:

Column 3, line 65, please delete "bath", and substitute therefor --both--.

Column 15, line 62, after 'using', please insert --a--.

Column 16, line 13, after 'air', please insert --source,--

Column 16, line 35, after 'annulus', please insert --,--.

Signed and Sealed this

Twenty-seventh Day of May, 1997

Bruce Lehman

*Attest:*

BRUCE LEHMAN

*Attesting Officer*

*Commissioner of Patents and Trademarks*